US008665039B2

(12) United States Patent
Yassini et al.

(10) Patent No.: US 8,665,039 B2
(45) Date of Patent: Mar. 4, 2014

(54) DUAL MODE CAVITY FILTER ASSEMBLY OPERATING IN A TE22N MODE

(75) Inventors: Bahram Yassini, Waterloo (CA); Ming Yu, Waterloo (CA)

(73) Assignee: COM DEV International Ltd., Cambridge (CA)

( * ) Notice: Subject to any disclaimer, the term of this patent is extended or adjusted under 35 U.S.C. 154(b) by 539 days.

(21) Appl. No.: 12/886,168

(22) Filed: Sep. 20, 2010

(65) Prior Publication Data

US 2012/0068792 A1 Mar. 22, 2012

(51) Int. Cl.
*H01P 1/207* (2006.01)

(52) U.S. Cl.
USPC ..... 333/202; 333/227; 333/212

(58) Field of Classification Search
USPC ..... 333/202, 208, 212, 227
See application file for complete search history.

(56) References Cited

U.S. PATENT DOCUMENTS

| | | | | |
|---|---|---|---|---|
| 4,453,146 | A | 6/1984 | Fiedziuszko | |
| 5,254,963 | A | 10/1993 | Bonetti et al. | |
| 5,774,030 | A | 6/1998 | Gray | |
| 6,066,996 | A * | 5/2000 | Goertz et al. | 333/202 |
| 6,538,535 | B2 * | 3/2003 | Guglielmi et al. | 333/208 |

FOREIGN PATENT DOCUMENTS

| | | | |
|---|---|---|---|
| EP | 0250857 | A2 | 1/1988 |
| EP | 0751579 | A1 | 1/1997 |
| WO | WO02/093681 | A1 | 11/2002 |

OTHER PUBLICATIONS

Notice of Allowance for European Application No. 10190575.0, dated Aug. 14, 2012.

Yassini B. et al: "A Ku-band high-Q tunable Filter with Stable Tuning Response" IEEE Transactions on Microwave Theory and Techniques Dec. 2009 Institute of Electrical and Electronics Engineers Inc. USA, vol. 57, No. 12, Dec. 2009, pp. 2948-2957.

European Search Report for Application No. EP 10190575 dated Feb. 28, 2011.

Development Program for a 200 kW, CW, 28-GHz Gyroklystron, H. Jory et al., Quarterly Report No. 14, Jul. through Sep. 1979, Prepared by Varian Associates, Inc. Palo Alto Microwave Tube Division, 611 Hansen Way, Palo Alto, California 94303 for Oak Ridge National Laboratory, Oak Ridge, Tennessee 37830, operated by Union Carbide Corporation for the Department of Energy, Contract No. W-7405-eng-26.

"Design and High-Power Test of a TE11-Mode X-Band RF Window With Taper Transitions", YOtake et al, KEK, National Laboratory for High Energy Physics, 1-1 Oho, Tukuba-shi, Ibaraki-ken, 305, Japan.

* cited by examiner

*Primary Examiner* — Benny Kee
(74) *Attorney, Agent, or Firm* — Isis E. Caulder; Bereskin & Parr LLP

(57) ABSTRACT

A microwave cavity filter is configured for operation in the dual $TE_{22N}$ mode to realize a very high Q factor at very high frequency ranges. The microwave filter is formed from using one or more cylindrical cavities in which two orthogonal field polarizations of the $TE_{22N}$ mode are excited and coupled together by means of a coupling element. Different combinations of inter-cavity irises provide for both direct and cross-coupling of aligned field polarizations in adjacent cavities, as required, to realize complex filter functions. The irises may be formed in either a side or end wall of the cavities for both collinear and planar mount configuration. Negative mode coupling also allows for transmission zeros to be realized on either side of the filter passband.

19 Claims, 24 Drawing Sheets

DUAL MODE CAVITY FILTER ASSEMBLY OPERATING IN A TE22N MODE

FIELD

Embodiments described herein relate generally to microwave resonator filters and, more particularly, to dual mode microwave resonator filters exhibiting low loss at very high frequency ranges.

INTRODUCTION

A microwave filter is an electromagnetic device that can be tuned to pass energy within bands of frequencies encompassing resonant frequencies of the filter, while substantially suppressing inter-band frequencies. The resulting bandpass characteristic of the microwave filter can be described by one or more different performance criteria. For example, insertion loss describes the amount of signal loss exhibited in the microwave filter's passband, rejection (or "isolation") describes the amount of signal attenuation exhibited in the filter's stopband, return loss relates to the ratio of signal power incident on and reflected from the filter, loss variation (sometimes referred to as "ripple") describes the flatness of the passband, and group delay is related to the phase characteristics of the filter throughout the passband.

One commonly used performance characteristic of microwave filters is the so-called quality ("Q") factor of the filter. The Q factor of a microwave resonator can be related to the proportion of energy stored by the resonator in relation to its losses. For a microwave filter realized using one or more resonators, the Q factor also provides a relation between the passband and centre frequency of the filter, as well as being related to both the insertion loss and pass-band flatness exhibited by the realized microwave filter. Generally, microwave filters having higher Q factors tend to have lower insertion loss and steeper roll-off in the transitional band between the filter's passband and the stopband, which result in a more square-shaped passband response. In contrast, filters having lower Q factors tend to exhibit increased insertion loss and a more gradual transitional band roll-off, which both decreases efficiency and increases inter-channel distortion (for example, if the filter is being deployed in a channel multiplexer). For at least these reasons, high Q factor filters may be preferably used in some telecommunications applications where excessive inter-channel distortion can be undesirable or is not permitted. Waveguide (hollow cavity) and dielectric resonator filters are two examples of generally high Q factor microwave filters. Depending on the application, Q factors on the order of about 8,000 to 16,000 can be realized using hollow cavity and dielectric resonator topologies.

SUMMARY OF THE INVENTION

In one broad aspect, some embodiments provide a microwave resonator assembly comprising: a cavity defined by an electrically conductive cylindrical enclosure in which electromagnetic energy radiated into the cavity resonates in a plurality of resonance modes comprising a dual $TE_{22N}$ mode, N greater than or equal to one; an input port provided in the cylindrical enclosure for radiating a first $TE_{22N}$ mode having a first polarization into the cavity; and a discontinuity formed within the cavity for electromagnetically coupling the first $TE_{22N}$ mode with a second $TE_{22N}$ mode having a second polarization orthogonal to the first polarization.

In another broad aspect, some embodiments provide a microwave resonator filter comprising: a plurality of cavities including at least a first cavity and a second cavity located adjacent to the first cavity, each of the first cavity and the second cavity defined by a corresponding electrically conductive cylindrical enclosure in which electromagnetic energy radiated into that cavity resonates in a plurality of resonance modes comprising a dual $TE_{22N}$ mode, N greater than or equal to one; and at least one coupling element for radiating electromagnetic energy between the first cavity and the second cavity, the at least one coupling element configured to electromagnetically couple a first $TE_{22N}$ mode resonating in the first cavity with a fourth $TE_{22N}$ mode resonating in the second cavity, and a second $TE_{22N}$ mode resonating in the first cavity with a third $TE_{22N}$ mode resonating in the second cavity, the first and fourth $TE_{22N}$ modes having a first polarization and the second and third $TE_{22N}$ modes having a second polarization orthogonal to the first polarization.

These and other aspects are set forth herein.

BRIEF DESCRIPTION OF THE DRAWINGS

A detailed description of various embodiments is provided herein below with reference to the following drawings, by way of example only, and in which.

Figure 1A:
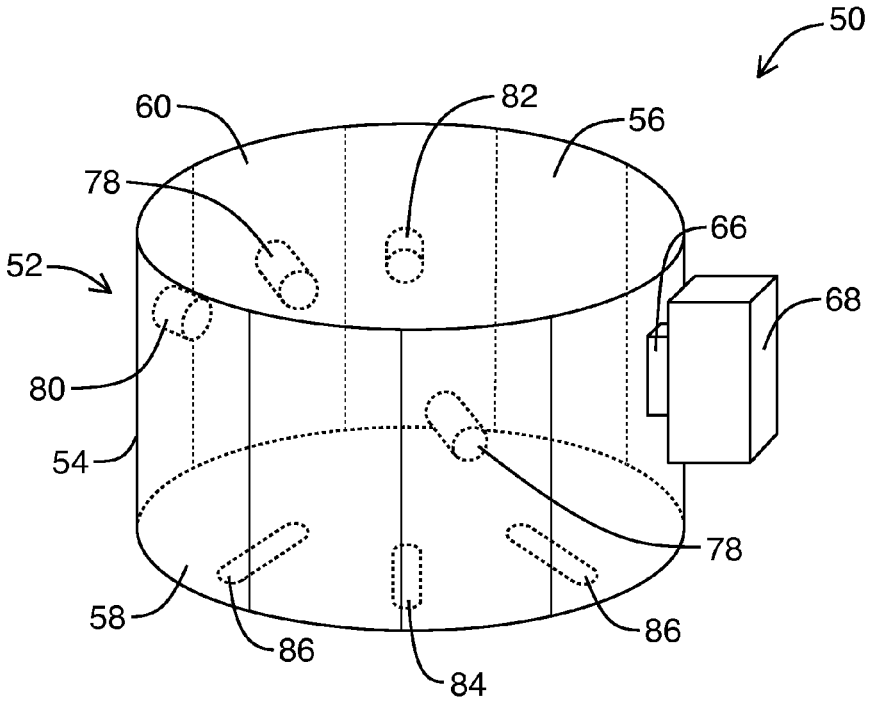
FIGS. 1A and 1B are perspective and top views of a microwave resonator assembly.

It will be understood that reference to the drawings is made for illustration purposes only, and is not intended to limit the scope of the embodiments described herein below in any way. For convenience, reference numerals may also be repeated (with or without an offset) throughout the figures to indicate like or analogous components or features.

DETAILED DESCRIPTION OF THE INVENTION

Microwave resonator filters are commonly designed to operate in the $TE_{11N}$ or $TE_{011}$ mode for high Q factor applications because, at lower frequency ranges, such as the C band (4-8 GHz) or the $K_u$ band (12-18 GHz), the $TE_{11N}$ or $TE_{011}$ modes can offer better performance than other resonance modes. For example, low loss filters having Q factors up to about 16,000 are realizable using the $TE_{11N}$ or $TE_{011}$ modes. Quality factors up to and exceeding those realizable using the $TE_{11N}$ or $TE_{011}$ modes of the same or higher order can be also achieved by designing the microwave filter to operate in higher order resonance modes, such as the $TE_{22N}$ mode. However, for microwave filters designed for the C or $K_u$ bands, the realized $TE_{22N}$ mode filter tends to be larger and bulkier as compared to the $TE_{11N}$ or $TE_{011}$ modes. In certain telecommunications applications, such as satellite or spacecraft installations, where size and weight can be important design constraints, the additional weight and bulk incurred by the $TE_{22N}$ mode filter may represent a significant overall cost. Often at the lower C and $K_u$ band frequencies, Q factors higher than 16,000 are unnecessary.

Depending on the application, however, at higher frequency ranges, such as the K band (18-27 GHz), microwave resonator filters realized using higher order resonance modes can begin to offer competitive design considerations. Although $TE_{22N}$ mode filters remain generally larger and bulkier, the size penalty between the higher order and lower order mode filters usually preferred at lower frequencies is not as dramatic at the higher K band frequencies. Given that the $TE_{22N}$ mode can achieve comparable or even superior Q factors, for higher frequency band applications, the superior Q factor offered by the $TE_{22N}$ mode may be traded off against the size penalty incurred relative to the $TE_{11N}$ or $TE_{011}$ modes. For example, Q factors of about 25,000 are realizable in 20 GHz, $TE_{22N}$ type filters.

The described embodiments provide a microwave resonator filter that operates in the dual $TE_{22N}$ mode to realize a very high Q factor at very high frequency ranges. The microwave resonator filter can comprise one or more cylindrical cavities in which two orthogonal field polarizations of the $TE_{22N}$ mode can be excited and coupled together using a suitably located coupling element. Different combinations of inter-cavity irises provide for both direct and cross-coupling of aligned field polarizations, as required, to realize complex filter functions, such as elliptical or Chebyshev functions, as well as other functions. Negative mode coupling also allows for transmission zeros to be realized on either side of the filter passband.

Figure 1B:
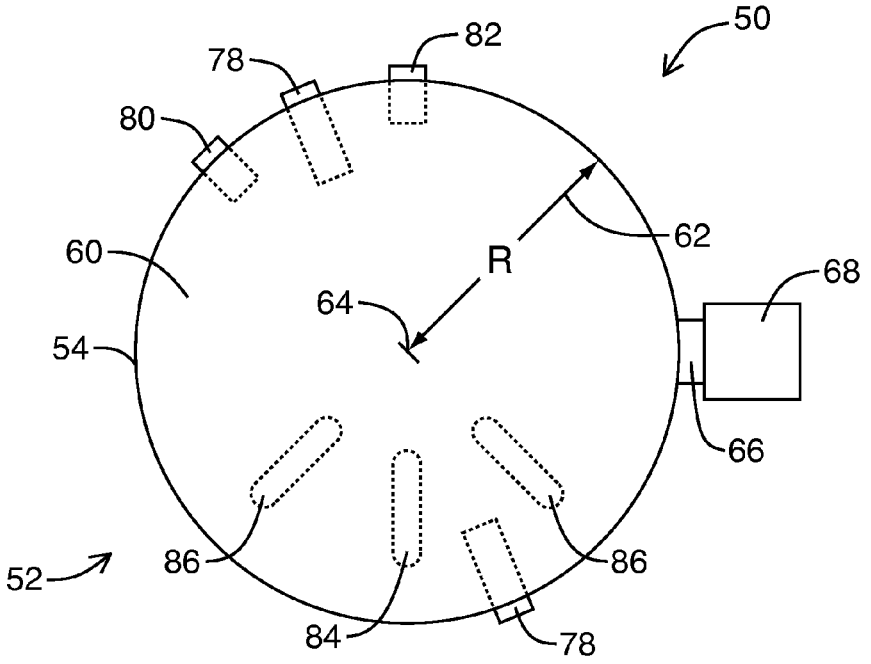

Referring initially to FIGS. 1A and 1B, there is shown a microwave resonator assembly 50 in perspective and top views. The microwave resonator assembly 50 is formed using a cylindrical enclosure 52, which can be constructed out of a suitable metal or other electrically conductive material. For example, the cylindrical enclosure 52 can be constructed out of aluminum, which is commonly used for spacecraft and other telecommunication applications due to its comparatively lightweight. As an alternative to aluminum, conductive materials having lower co-efficients of thermal expansion, including nickel-steel alloys such as INVAR, can be used to form the cylindrical enclosure 52 to obviate or at least reduce the need for temperature compensation devices to be incorporated into the microwave resonator assembly 50. However, whether aluminum or nickel-steel alloy is used, temperature compensative devices may be used. The nickel-steel alloys also tend to be denser, more expensive and more difficult to machine than aluminum. In some cases, the conductive properties of the cylindrical enclosure 52 can be improved by adding a thin coating of silver, for example, or some other metal having better conductive properties than the base metal used to form the cylindrical enclosure 52.

The cylindrical enclosure 52 includes a cylindrical sidewall 54 extending between opposing end walls 56 and 58 and is hollow, as illustrated in FIG. 1A, thereby defining a cavity 60 in the interior space of the cylindrical enclosure 52. Any suitable technique for forming the cylindrical enclosure 52 may be used. For example, the cylindrical sidewall 54 and end wall 56 can be formed or shaped into a unitary piece of metal, with the opposing end wall 58 formed as a separate piece and attached to the cylindrical sidewall 54 after the fact. As will be appreciated, a metallic weld or alternatively mechanical fasteners (e.g., screws) can be used for this purpose. In the latter case, a mounting flange or lip (not shown) can also be incorporated into the sidewall 54 adjacent to where the connection is made with the end wall 58. Screw holes (not shown) aligned with corresponding screw mounts in the flange can also be bored or otherwise formed in the end wall 58 for making the mechanical connection. Of course, other techniques for forming the cylindrical enclosure 52 may also be apparent.

As illustrated in FIGS. 1A and 1B, the cylindrical enclosure 52 has a circular cross-section defined by a radius (R) 62 (FIG. 1B) extending outwardly in a transverse plane in all directions from a longitudinal axis 64 of the cylindrical enclosure 52. Alternatively, the cross-section of the cylindrical enclosure 52 can also be some pseudo-circular shape, such as an octagon or higher-degree polygon, which exhibits 90-degree radial symmetry and thereby approximates the boundary conditions presented by a perfectly circular cross-section. In such alternative configurations, the cross-section of the cylindrical enclosure 52 can be characterized by an effective radius, as opposed to a true radius, (i.e., which approximately defines the shortest distance between the longitudinal axis 64 (FIG. 1B) and any point on the inner sidewall 54). As used herein throughout, the term 'cylindrical' should be understood as including both circular pseudo-circular geometries, as noted above.

Input port 66 is provided in the cylindrical enclosure 52 for radiating electromagnetic energy into the cavity 60 from an external waveguide section 68 or coaxial cable (not shown). Different structures can also be utilized for realizing the input port 66, as will be appreciated. In the embodiment explicitly shown in FIGS. 1A and 1B, input port 66 is formed as an aperture (or iris) extending completely through the sidewall 54 to form a continuous volume between the external waveguide section 68 and the cavity 60. With this arrangement, electromagnetic waves transmitted along the waveguide section 68 are coupled into the cavity 60 due to field interactions between the electromagnetic energy inside the cavity 60 and the incident electromagnetic wave. Alternatively, a coaxial coupler, comprising an outer cylindrical conductor separated from an interior conductive probe by a dielectric mounting plate, or some other suitably configured electromagnetic probe can be used to couple electromagnetic energy into the cavity 60.

It should be appreciated that the designation of an "input" port is somewhat arbitrary and made only for the sake of clarity. Depending on the particular application to which the resonator assembly 50 is used, the input port 66 could instead be used as an output port for radiating stored electromagnetic energy out of the cavity 60 to the external waveguide section 68. However, in the event that the resonator assembly 50 is used to realize a non-symmetrical filter (containing distinct "input" and "output" ports), the designation of input port 66 as such will be followed throughout. It should also be appreciated that the input port 66 may be used to couple the cavity 60 with some microwave component other than external waveguide section 68, such as a second cavity located adjacent to the first cavity 60, and thereby used to radiate electromagnetic energy between the two adjacent cavities 60, as in a multi-cavity microwave resonator filter.

Figure 2:
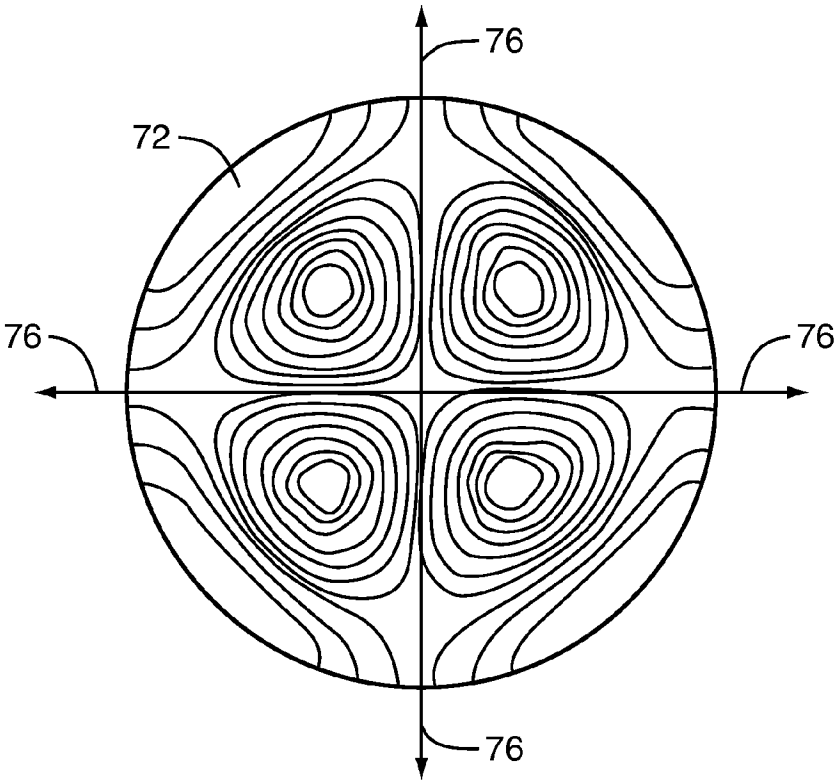
FIG. 2 is a diagram showing expected field patterns of the dual $TE_{22N}$ mode when excited in the microwave resonator assembly of FIGS. 1A and 1B.
Figure 2:
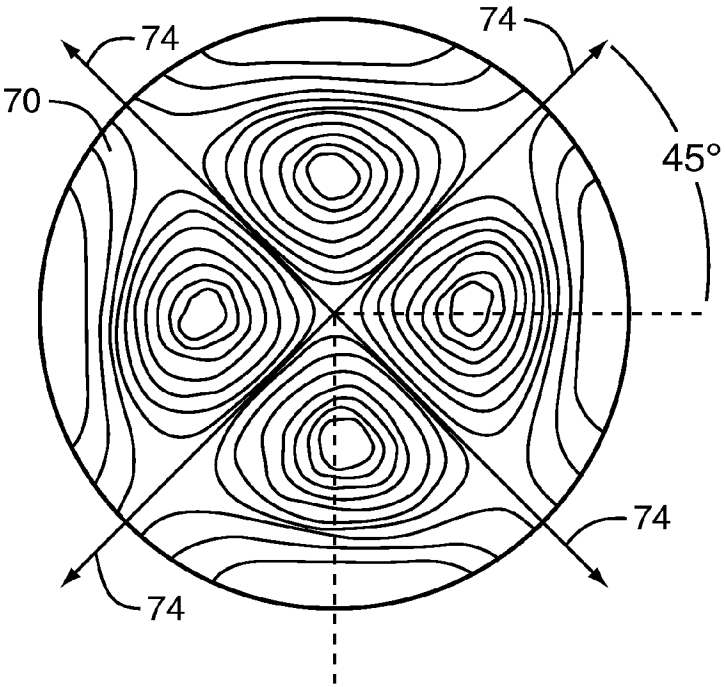

Referring now to FIG. 2, electromagnetic energy radiated into the cavity 60 of FIGS. 1A and 1B can be excited into an infinite number of different resonance modes, each of which is characterized by a corresponding resonant frequency and is supported by the particular geometry of the cavity 60. In general, microwave filters are designed to operate in only one particular resonance mode, which defines a frequency range of operation for the filter, for example in terms of a centre frequency and bandwidth. Other unwanted (or spurious) modes appearing in the cavity and characterized by other resonant frequencies, therefore, represent an effective limit on the operational range of the filter. In addition to the $TE_{11N}$ and $TE_{011}$ modes commonly used in lower frequency telecommunications applications, the cylindrical shape of the cavity 60 also supports the $TE_{22N}$ dual resonance mode. As will be appreciated, the third co-efficient index, "N", indicates the repetition rate (in terms of half wavelengths) of the resonance mode's electromagnetic field pattern in the axial direction and can be any integer greater than or equal to one. The cylindrical geometry of the cavity 60 supports all $TE_{22N}$ modes, although as a practical matter, the $TE_{221}$ mode may be preferred to other higher modes for its larger spurious free range as compared to higher $TE_{22N}$ modes. A mode chart can be consulted for a complete listing of resonance modes supported by the cavity 60.

Due to the 90-degree radial symmetry of the cavity 60, two distinct $TE_{22N}$ modes may be excited in the cavity 60. Thus, the $TE_{22N}$ mode can be referred to as a dual mode to reflect the fact that two electromagnetic resonators having the same resonant frequency are supported simultaneously by one physical cavity. Relative to the first $TE_{22N}$ mode 70 (leftmost field pattern shown in FIG. 2), the second $TE_{22N}$ mode 72 (field pattern shown in FIG. 2) has the same electromagnetic field pattern, but an orthogonal polarization. As will be appreciated and as used herein throughout, two modes are referred to as being 'orthogonal' modes, if for a perfectly symmetrical cavity, the respective E and H field components of the two modes are oriented 90-degrees relative to one another at all points within the cavity. As the two $TE_{22N}$ modes 70 and 72 are "orthogonal" to one another, they naturally co-exist within the cavity 60 without substantial field interactions, so that electromagnetic energy excited in one of the $TE_{22N}$ modes 70 and 72 is contained within that given mode and, in the absence of a discontinuity or coupling element formed within the cavity 60, would not leak over into the other "orthogonal" mode.

Using the two characterizing vectors 74 and 76 to establish a reference angular position within the cavity 60, the second $TE_{22N}$ mode 72 is 45-degrees offset from the first $TE_{22N}$ mode 70 in the transverse plane to the longitudinal axis 64 of the cavity 60. (In other words, a 45-degree angle is formed between the two characterizing vectors 74 and 76). The choice of the two characterizing vectors 74 and 76 is somewhat arbitrary because, owing to the 90-degree radial symmetry of the first and second $TE_{22N}$ modes 70 and 72, any one of 4 different vectors (shown in FIG. 2) can be selected for each $TE_{22N}$ mode 70 and 72 to serve as the characterizing vector. In either case, the set of 4 vectors are oriented 90-degrees offset from one another. For sake of clarity, reference will simply be made to the characterizing vectors 74 and 76, which can be any of the vectors illustrated in FIG. 2.

Referring back to FIGS. 1A and 1B, electromagnetic energy radiated into the cavity 60 through the input port 66 will be excited into one of the two $TE_{22N}$ modes 70 or 72 (shown in FIG. 2), if the incident electromagnetic wave is radiated at or near to the resonant frequency of the $TE_{22N}$ dual mode. Which of the two orthogonal polarizations is excited within the cavity 60 can depend on the particular mechanism of input coupling and the angular position of the input port 66 in relation to the two characterizing vectors 74 and 76, as will be explained in more detail below. The other of the two $TE_{22N}$ modes 70 or 72 not directly coupled to the input port 66 is simultaneously excited within the cavity 60 by forming at least one discontinuity within the cavity 60 at a corresponding location within the cavity 60, where each of the $TE_{22N}$ modes 70 and 72 have non-zero field components. For example, coupling of the two $TE_{22N}$ modes 70 and 72 is accomplished using one or more coupling screws 78 projecting through the sidewall 54 (or alternatively end walls 56 or 58) into the interior of the cavity 60. Alternatively, other structures that disturb the radial symmetry of the cavity 60 can be used to provide intra-cavity coupling between the two orthogonal $TE_{22N}$ modes 70 and 72, including deformations (convex or concave) formed in the sidewall 54, dielectric blocks mounted within the cavity 60 or other dielectric boundary conditions, and the like. The term "discontinuity" is understood to encompass each of the above-noted disturbances to the 90-degree radial symmetry of the cavity 60.

Tuning screws 82 and 80, which like the coupling screws 78 project through the sidewall 54 into the interior of the cavity 60, are used for making fine adjustments to the resonant frequencies of the first and second $TE_{22N}$ modes 70 and 72, respectively. The location of the tuning screws 82 and 80 within the cavity 60 determines which of the two orthogonal $TE_{22N}$ modes 70 and 72 are affected. For example, the tuning screw 82 is used to adjust the resonant frequency of the first $TE_{22N}$ mode 70 (defined by characterizing vector 74) and has comparatively less effect on the resonant frequency of the second $TE_{22N}$ mode 72 (defined by characterizing vector 76). On the other hand, the tuning screw 80, which is located at a 45 degree angular offset from the tuning screw 82 is used to adjust the resonant frequency of the second $TE_{22N}$ mode 72, while having comparatively little effect on the resonant frequency of the first $TE_{22N}$ mode 70. The tuning screws 82 and 80 therefore provide relatively independent tuning of the first and second $TE_{22N}$ modes 70 and 72 and can be used, for example, to compensate for resonant frequency shifting caused by other components of the resonator assembly 50, such as input port 66, coupling screws 78, etc.

The resonator assembly 50 also includes at least one coupling element for radiating electromagnetic energy out of the cavity 60 (e.g., into an adjacent cavity to realize a multi-cavity filter having 4 or more poles). In the embodiment explicitly shown in FIGS. 1A and 1B, the resonator assembly 50 includes radial iris 84 and radial irises 86. As will be explained in more detail below, the angular position of the radial irises 84 and 86 in relation to the characterizing vectors 74 and 76 determines which of the two $TE_{22N}$ modes 70 and 72 are predominantly coupled. As shown, the radial iris 84 couples the first $TE_{22N}$ mode 70, due to its angular position within the cavity 60, while providing substantially less coupling of the orthogonal $TE_{22N}$ mode 72. Moreover, the two radial irises 86 (which are each located at a 45-degree angular offset from the radial iris 84) achieve the opposite effect of coupling the second $TE_{22N}$ mode 72 predominantly while providing substantially less coupling of the orthogonal $TE_{22N}$ mode 70. The size and location of the radial irises 84 and 86 also determine the amount of coupling between aligned modes in adjacent cavities, as will be explained in more detail below.

Although not explicitly illustrated in FIGS. 1A and 1B, a temperature compensation device can also be included in the microwave resonator assembly 50. The temperature compensation device can be used to stabilize the resonant frequency of the $TE_{22N}$ modes 70 and 72 over a range of different operating temperatures as follows. When the resonator assembly 50 is subjected to a temperature gradient, the material used to form the cylindrical enclosure 52 will expand or contract according to its co-efficient of thermal expansion. For example, aluminum has a relatively large co-efficient of thermal expansion as compared to the temperature stabilized nickel-steel alloys. Expansion or contraction of the cylindrical enclosure 52 causes a corresponding change in the volume of the cavity 60 defined therewithin. Since the resonant frequency of the dual $TE_{22N}$ mode is related to the volume of the cavity 60, without some form of temperature compensation, that frequency can "drift" about its centre point over the range of operating temperatures as the cavity 60 expands and contracts.

As will be appreciated, different approaches to providing temperature compensation in the resonator assembly 50 are possible. For example, a temperature compensation device can be mounted to the exterior portion of end wall 56 or 58, whichever is free and not used for external mounting of the resonator assembly 50. The temperature compensation device can comprise a strap or end cap assembly of a comparatively low thermal expansion material coupled to the exterior wall portion, so that as the operating temperature of the resonator assembly 50 increases, the strap or end cap assembly exerts a force on the end wall 56 or 58 to bend or flex the end wall 56 or 58 inwardly. The corresponding decrease in cavity volume due to the inward flexing of the end wall 56 or 58 counterbalances the corresponding increase in cavity volume due to radial expansion of the cavity 60, thereby maintaining an essentially constant cavity volume over the entire operating range of the resonator assembly 50. Accordingly, for both planar and stack-up (collinear) configurations having side launch termination (i.e., input/output coupling provided in the sidewall 54), the resonator assembly 50 can accommodate a temperature compensation device to adjust an exposed end wall 56 or 58 and, consequently, the axial length of the cavity 60 in order to compensate frequency drift due to temperature gradients. While the strap or end cap assembly explicitly described above represents one possible temperature-compensating device, still other mechanisms for providing temperature compensation may be apparent.

Figure 3:
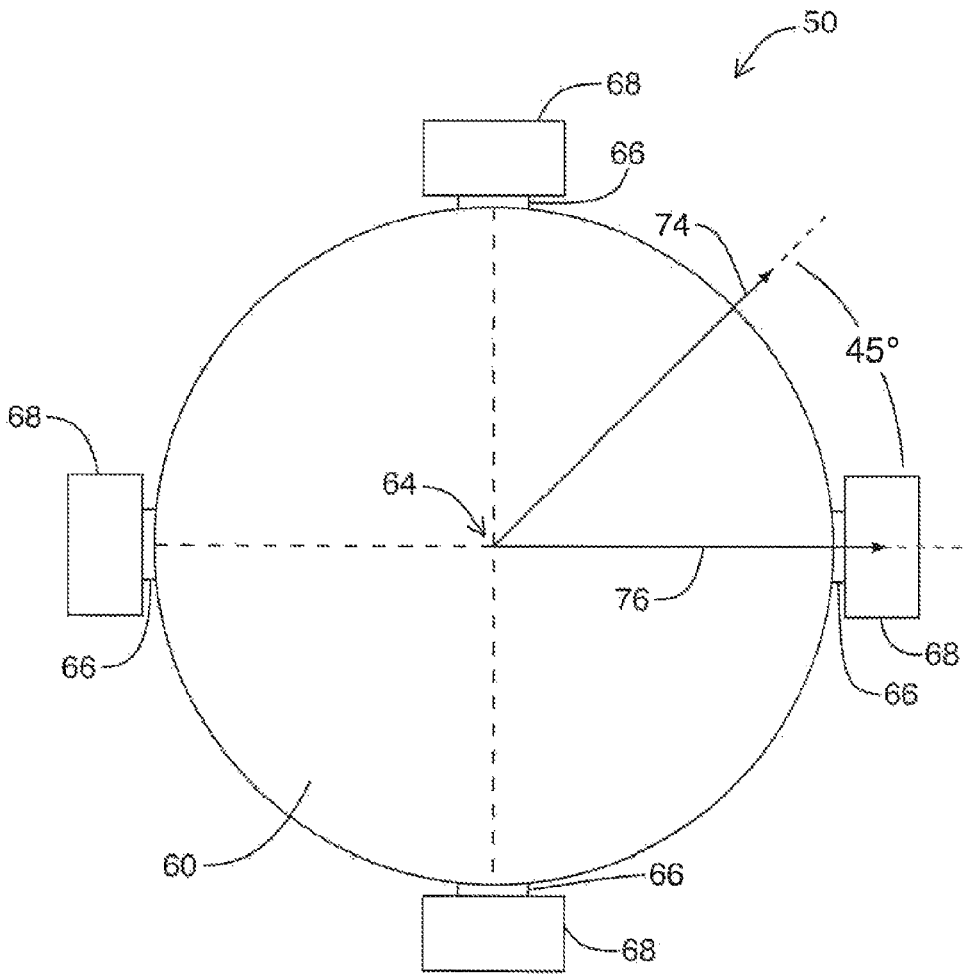
FIG. 3 is a schematic diagram showing alternative locations for an input port included in the microwave resonator assembly of FIGS. 1A and 1B.

Referring now to FIG. 3, different locations for the input port 66 within the cavity 60 are possible because of the 90-degree radial symmetry of the $TE_{22N}$ dual mode. Four such locations for the input port 66 are shown in FIG. 3, spaced 90-degrees apart from each other, at locations within the cavity 60 having an angular position, in relation to the characterizing vector 76, equal to an integer multiple of 90 degrees. As used herein throughout, the term "integer multiple" should be understood as including every whole number multiple, positive and negative, as well as zero. In general, when the input port 66 is realized using an iris or aperture defined through the sidewall 54, the characterizing vector of the coupled $TE_{22N}$ mode will be offset essentially 45-degrees from the input port 66, plus an integer multiple of 90 degrees, regardless of the absolute angular position of the input port 66 within the cavity 60. Thus, each of the four locations for the input port 66 explicitly shown in FIG. 3 would be suitable for exciting the first $TE_{22N}$ mode 70 as these locations are 45-degrees offset from the characterizing vectors 74 shown in FIG. 2. It follows also that by rotating the angular position of the input port 66 within the cavity 60 by 45 degrees, relative to one of the locations explicitly shown in FIG. 3, the input port 66 would be made suitable for exciting the second $TE_{22N}$ mode 72 defined by the second characterizing vector 76. Of course, it should be appreciated that the terms "first" and "second" are used herein throughout only to distinguish between the two orthogonal polarizations of the dual $TE_{22N}$ mode.

Figure 4B:
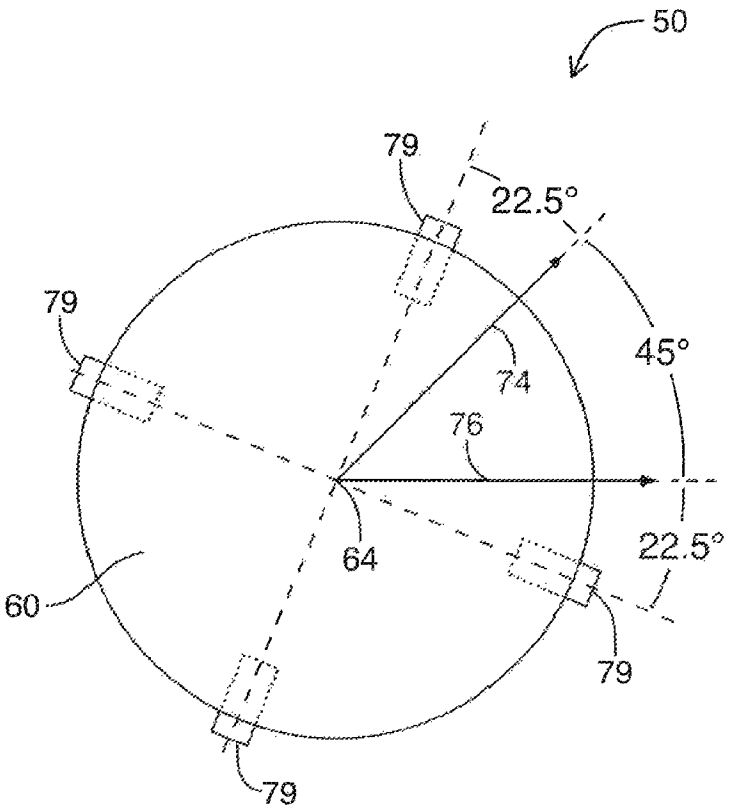
FIGS. 4A and 4B are schematic diagrams showing alternative locations for a coupling screw included in the microwave resonator assembly of FIGS. 1A and 1B.
Figure 4A:
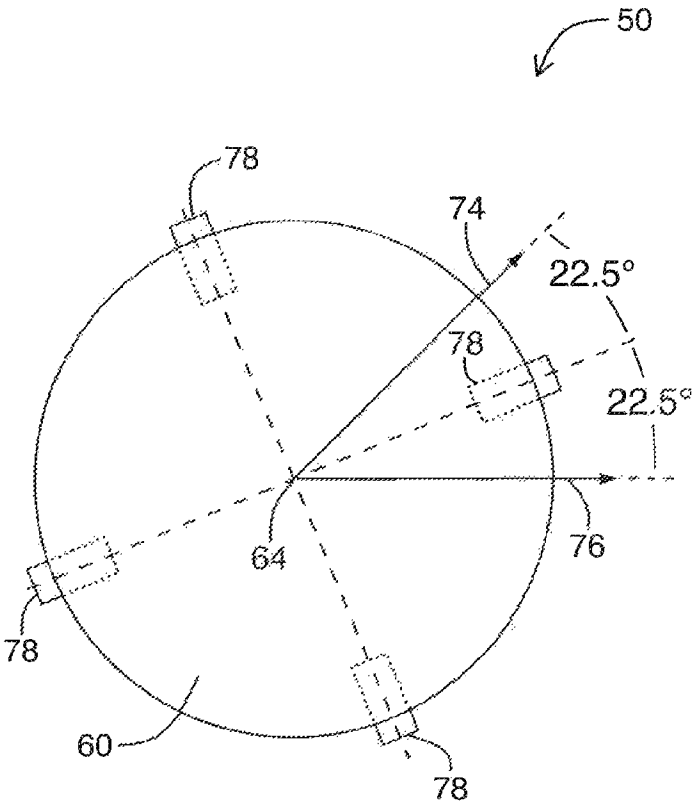

Referring now to FIGS. 4A and 4B, the 90-degree symmetry of the dual $TE_{22N}$ mode also results in different possible locations for the coupling screw 78 as illustrated in FIG. 4A (or 79 as illustrated in FIG. 4B) to be formed within the cavity 60 for coupling together the two orthogonal $TE_{22N}$ modes 70 and 72. More generally, any electromagnetic discontinuity, such as those described above, can be formed at the locations indicated. To provide good intra-cavity mode coupling, the electromagnetic discontinuity, or discontinuities, should be formed at a location within the cavity 60 where each of the orthogonal $TE_{22N}$ modes 70 and 72 have non-zero field components, so that by perturbing the field pattern of the first $TE_{22N}$ mode 70, an appreciable amount of electromagnetic energy will transfer into the orthogonal polarization and thereby indirectly excite the second $TE_{22N}$ mode 72. A single coupling screw 78 (or 79) can be projected into the cavity 60 at one of the locations indicated, depending on the particular application, if the single coupling screw 78 or 79 provides the required amount of mode coupling. However, multiple screws 78 (such as the two screws 78 seen in FIGS. 1A and 1B), or other discontinuities, can be included in the resonator assembly 50 to increase coupling of the two $TE_{22N}$ modes 70 and 72 as required.

Using the characterizing vectors 74 and 76 as reference angular positions, the coupling screw 78 can be located so as to have an angular position within the cavity 60 that is substantially intermediate the two characterizing vectors 74 and 76. In a particular case, the coupling screw 78 can be located at the angular midpoint between the two characterizing vectors 74 and 76, so that the angular position of the coupling screw 78 bisects the 45-degree angle formed between the two characterizing vectors 74 and 76, 22.5 degrees offset from each respective vector. Although it is not strictly necessary for the coupling screw 78 to be located at the precise angular midpoint between the two characterizing vectors 74 and 76, for good coupling between the orthogonal $TE_{22N}$ modes 70 and 72, the angular spacing of the coupling screw 78 from each characterizing vector 74 and 76 can be more than minimal. A screw or other electromagnetic discontinuity aligned with either of the two characterizing vectors 74 or 76 would provide substantially less coupling of the two $TE_{22N}$ modes 70 than does the coupling screw 78 when positioned intermediate the two characterizing vectors 74 and 76.

It will also be understood that the axial position of the coupling screw 78 is optimizable and can depend on the axial repetition rate of the dual $TE_{22N}$ mode field pattern (i.e., the value of "N"), depending on the amount of coupling required for the particular application. Since each increment of "N" represents one half-wavelength in the axial field pattern of the dual $TE_{22N}$ mode, the order of the $TE_{22N}$ prescribes certain E-field maxima along the axial length of the cavity 60, and based upon which the coupling screw 78 can be located to provide good coupling. As will be appreciated, the $TE_{221}$ mode has one E-field maximum located at the axial midpoint of the cavity 60, the $TE_{222}$ mode has two E-field maxima located at the one and three-quarter heights of the cavity 60 and, in general, the $TE_{22N}$ mode has E-field maxima located at odd integer multiples of one-quarter wavelength. The coupling screw 78 may conveniently be located at these axial positions exhibiting respective E-field maxima, although it is not necessary and other axial locations can provide sufficient coupling as well. Accordingly, the range of suitable locations for the coupling screw 78 can be generalized to include a plurality of different locations within a wedge of the cavity 60, defined by the longitudinal axis 64, the two characterizing vectors 74 and 76, and the arcuate portion of the sidewall 54 subtended between the two characterizing vectors 74 and 76.

Again due to the 90-degree radial symmetry of the dual $TE_{22N}$ mode, the one or more electromagnetic discontinuities used for inter-mode coupling can be formed at different locations within the cavity 60. Eight exemplary locations are illustrated in FIGS. 4A and 4B, which are separated into two sets of four locations each based on the relative sign of the inter-mode coupling that is realized at each respective location. Coupling screws 78 are spaced 90-degrees apart from each other and at angular positions, in relation to the first characterizing vector 74, equal to negative 22.5 degrees plus an integer multiple of 90 degrees. Coupling screws 79 are also spaced 90-degrees apart from each other but are located at angular positions, in relation to the first characterizing vector 74, equal to positive 22.5 degrees plus an integer multiple of 90 degrees. Thus, the set of coupling screws 79 is 45-degrees offset with respect to the set of coupling screws 78. Consequently, for a given polarity of the $TE_{22N}$ mode 70, the corresponding polarity of the $TE_{22N}$ mode 72 when excited by the coupling screws 78 will be opposite to that of the $TE_{22N}$ mode 72 when excited by the coupling screws 79. (It is noted that the angular positions of coupling screws 78 and 79 could equivalently be defined in relation to the characterizing vector 76 and is defined with reference to characterizing vector 78 for convenience only.)

Figure 5A:
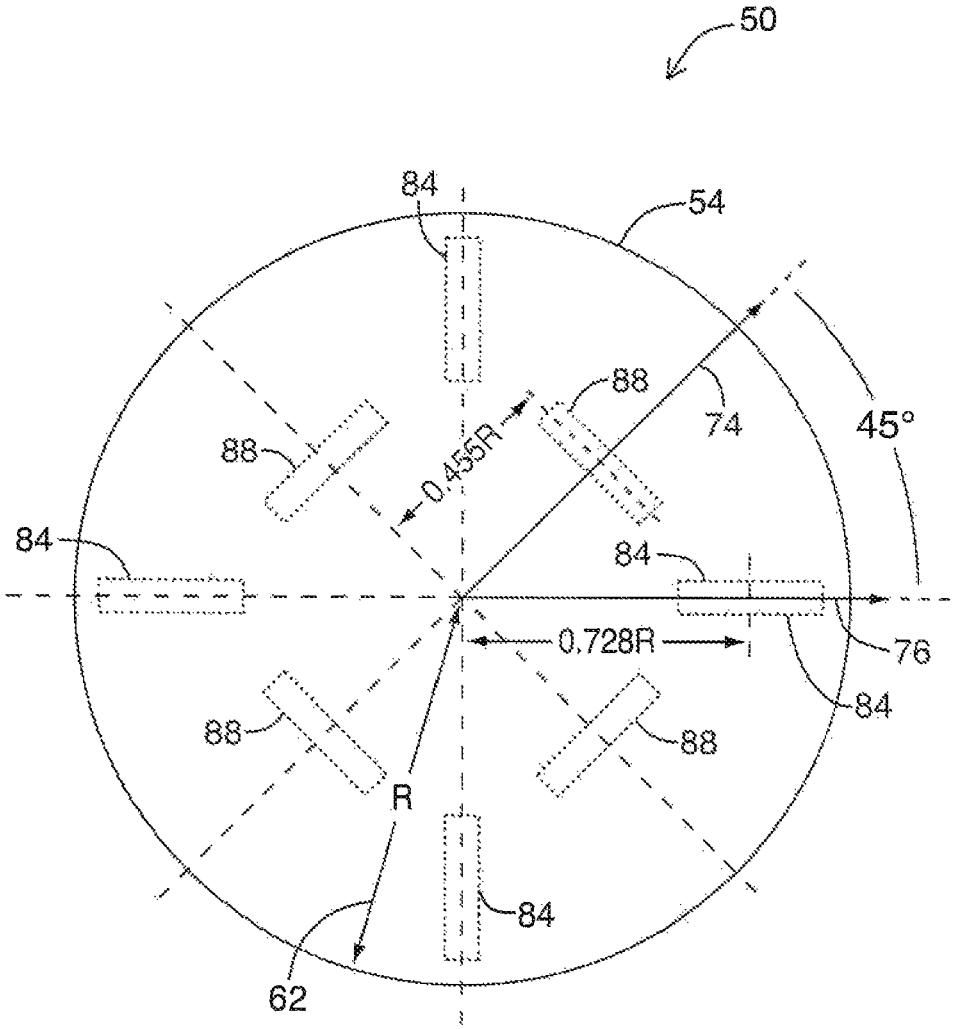
FIGS. 5A and 5B are schematic diagrams showing alternative locations for a transverse angular or radial iris included in the microwave resonator assembly of FIGS. 1A and 1B.
Figure 5B:
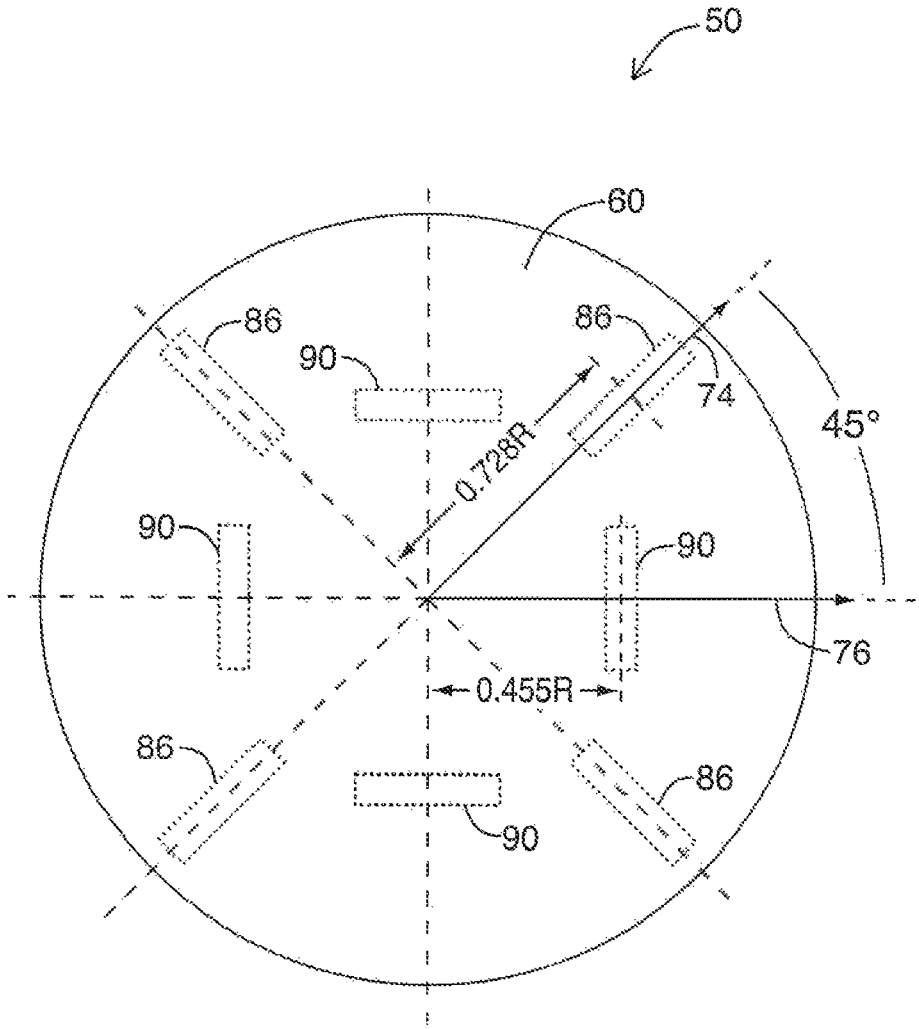

Referring now to FIGS. 5A and 5B, one or more different coupling elements can be included in the resonator assembly 50 for radiating one or both of the $TE_{22N}$ modes 70 and 72 out of the cavity 60. The coupling elements can be provided in either the sidewall 54 or the end wall 58 (as illustrated in FIGS. 1A and 1B) in different configurations of the resonator assembly 50. In each case, the shape and location (axial and angular) of the coupling element within the cavity 60 can influence the amount of coupling achieved with respect to each of the two orthogonal $TE_{22N}$ modes 70 and 72, Coupling elements formed at certain locations and angular positions within the cavity 60 also couple one of the $TE_{22N}$ modes substantially more than the other orthogonal mode. The iris configurations illustrated in FIG. 5A provide relatively more coupling of the first $TE_{22N}$ mode 70 defined by characterizing vector 74, while those illustrated in FIG. 56 provide relatively more coupling of the second $TE_{22N}$ mode 72 defined by characterizing vector 76.

As seen in FIG. 5A, radial iris 84 is formed in the end wall 58 having an angular position equal to an integer multiple of 90-degrees, in relation to the second characterizing vector 76. Four such locations for the radial iris 84 are indicated due to 90-degree radial symmetry in the cavity 60, namely at 0, 90, 180 or 270 degrees (and hence at integer multiples of 90 degrees) offset from the second characterizing vector 76. Each of the radial irises 84 has a generally rectangular shape forming an elongated, slot-shaped aperture extending predominantly outwardly from the longitudinal axis 64 of the cavity 60 in the radial direction. Thus, the radial iris 84 can be substantially aligned with the effective radius 62 but can also have some radial skew or yaw. The radial iris 84 can have square corners as shown or alternatively can have rounded edges to realize a higher Q factor. The centre of the radial iris 84 is spaced apart from the longitudinal axis 64 by a radial distance of approximately 0.728R, where R is the actual or effective radius of the cavity 60. As can be seen from FIG. 2, for example, at this radial distance (and angular position with the cavity 60), the first $TE_{22N}$ mode 70 has relatively dense E-field lines extending orthogonal to the radial iris 84, indicating that a radial iris 84 having the radial spacing, orientation and angular position shown in FIG. 5A would provide good coupling of the first $TE_{22N}$ mode 70.

While a radial distance of 0.728R represents one possibility, the spacing for the radial iris 84 is optimizable to fit the particular microwave application. For example, the relatively strong coupling achieved when the radial iris 84 is spaced at 0.728R from the longitudinal axis 64 can make this radial position suitable for wideband applications. Other radial positions spaced apart from the 0.728R point may otherwise be suitable for narrowband applications due to the relatively weaker coupling that can be expected at these other radial positions. Accordingly, a radial spacing greater than about 0.455R may be appropriate for different applications. The length of the radial iris 84 can also be adjusted as needed when the radial iris 84 is shifted away from the 0.728R point to compensate for some of the consequent loss of bandwidth. Moreover, depending on bandwidth requirements, the radial iris 84 can also be located (not shown) at a radial distance of about 0.25R, or more generally between about 0.1 R to 0.4R. This approximate range may be suitable again for some more narrowband applications. As will be appreciated, the radial iris 84 can also have different shapes other than rectangular, such as a triangle or sector.

In addition to, or in place of, the radial iris 84, transverse angular iris 88 is also suitable for coupling the first $TE_{22N}$ mode 70. Transverse angular iris 88 is formed in the end wall 58 having an angular position equal to an integer multiple of 90-degrees, in relation to the first characterizing vector 74. Thus, again four different locations for the transverse angular iris 88 are indicated due to 90-degree radial symmetry in the cavity 60, which occur at 0, 90, 180 or 270 degrees offset from the first characterizing vector 74. Each of the transverse angular irises 88 shown have a generally rectangular shape, but elongated now in a direction transverse to the real or effective radius of the cavity 60 (i.e., in an "angular" or "tangential" direction). The centre of each transverse angular iris 88 is shown spaced apart from the longitudinal axis 64 by a radial distance of approximately 0.455R. The relatively dense, orthogonal E-field lines of the first $TE_{22N}$ mode 70 (FIG. 2) at these radial and angular positions again indicate their suitability for coupling the first $TE_{22N}$ mode.

Like the radial iris 84, the radial spacing of the transverse angular iris 88 is also optimizable to fit the particular microwave application. While a radial spacing of 0.455R may be suitable for wideband applications, a radial distance of between about 0.25R and 0.728R for the transverse angular iris 88 may still be suitable for some narrowband applications. Optionally, the length of the transverse angular iris 88 can also be adjusted to control the achievable bandwidth. A separate range of radial distances of between about 0.85R and the sidewall 54 (i.e., greater than 0.85R) may also be suitable for some narrowband applications, due to the relatively weaker coupling that can be expected at these other radial positions in comparison to have 0.455R when the E-field lines of the first $TE_{22N}$ mode are denser. The transverse angular iris 88 can be rectangular (as shown) or arcuate in a trajectory tangential to the sidewall 54, and can have some angular skew or be substantially orthogonal to the effective radius 62. The edges of the transverse angular iris 88 can also be square or rounded to realize a higher Q factor.

FIG. 5B shows radial irises 86 and transverse angular irises 90, similar to the radial irises 84 and 88 illustrated in FIG. 5A, but at locations within the cavity 60 that are suitable for coupling the second $TE_{22N}$ mode 72 defined by characterizing vector 76 (as opposed to the first $TE_{22N}$ mode 70 defined, by characterizing vector 74). Radial irises 86 are located at an angular position equal to an integer multiple of 90-degrees in relation to the first characterizing vector 74, and are therefore 45-degrees offset with the radial irises 84. However, like radial irises 84 as illustrated in FIG. 5A suitable for coupling the first $TE_{22N}$ mode 70, the radial irises 86 can be located at a radial distance from the longitudinal axis 64 equal to any of the distances or ranges discussed above depending on the application and bandwidth requirements of the resonator assembly 50. In the exemplary case illustrated, each radial iris 86 can be centered at a radial distance approximately equal to 0.728R.

The transverse angular irises 90 shown in FIG. 5B are located at an angular position equal to an integer multiple of 90-degrees in relation to the second characterizing vector 76, which is 45-degrees offset with respect to the transverse angular irises 88 as illustrated in FIG. 5A. The approximate radial distances and ranges indicated for the transverse angular iris 88 also apply to the transverse angular irises 90, except that transverse angular irises 90 provide good coupling of the second $TE_{22N}$ mode 72 at these locations within the cavity 90. The particular radial distance selected for the transverse angular iris 90 can again depend on bandwidth requirements or other factors. In an exemplary case, the transverse angular iris 90 can be located at about 0.455R, where R is the effective radius of the cavity 60.

Referring now to FIGS. 6A-6F, there are illustrated some exemplary combinations of coupling elements that can be formed in the end wall 58 for radiating one or both of the $TE_{22N}$ modes 70 and 72 (as illustrated in FIG. 2) out of the cavity 60. It should be appreciated that the examples shown in FIGS. 6A-6F are illustrative only and not to be understood as representing an exhaustive set of all possible combinations of coupling elements. As can be seen from the example configurations shown, the number and location of each type of coupling element is optimizable to provide different strengths and relative proportions of coupling. In some cases, a single coupling element may be used to couple a given $TE_{22N}$ mode (either the first $TE_{22N}$ mode 70 or the second $TE_{22N}$ mode 72, as the case may be). In other cases, multiple coupling elements can be used simultaneously to provide greater amounts of coupling. As examples only, the set of coupling elements formed in the end wall 58 can also include all radial irises, all transverse angular irises, or a mix of radial and transverse angular irises, in addition to other shapes or orientations of coupling elements.

Figure 6B:
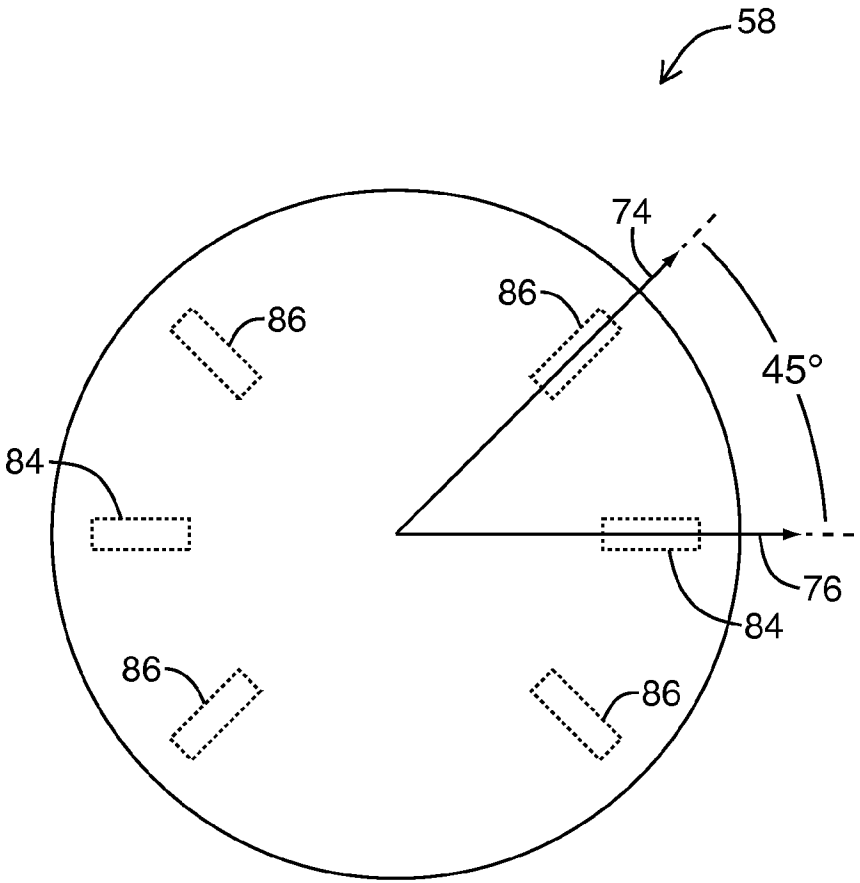
FIGS. 6A-6F are schematic diagrams showing some illustrative combinations of the transverse angular and radial irises shown in FIGS. 5A and 5B.
Figure 6A:
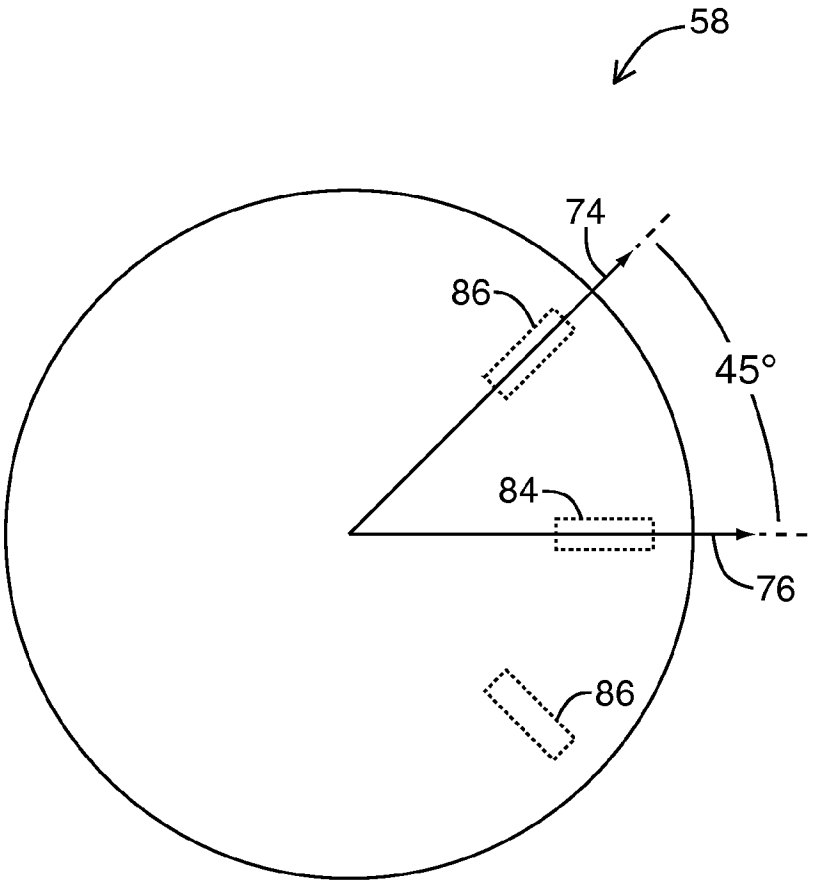

The combination shown in FIG. 6A includes a radial aperture 84 together with a pair of radial apertures 86 located at a 45-degree angular offset (positive and negative, respectively) from the radial aperture 84. The radial aperture 84 (aligned with the characterizing vector 76) couples the first $TE_{22N}$ mode 70, while the radial apertures 86 (an integer multiple of 90-degrees offset from the characterizing vector 74) jointly couple the second orthogonal $TE_{22N}$ mode 72. The combination in FIG. 6B is similar to that shown in FIG. 6A, but now includes a pair of radial irises 84 together with two pairs of radial irises 86 arranged diametrically opposed. Again the radial irises 84 provide coupling of the first $TE_{22N}$ mode 70, while the radial irises 86 provide coupling of the second $TE_{22N}$ mode 72. The combinations shown in FIGS. 6A and 6B are two examples of coupling being provided by all radial irises 84 or 86.

Figure 6D:
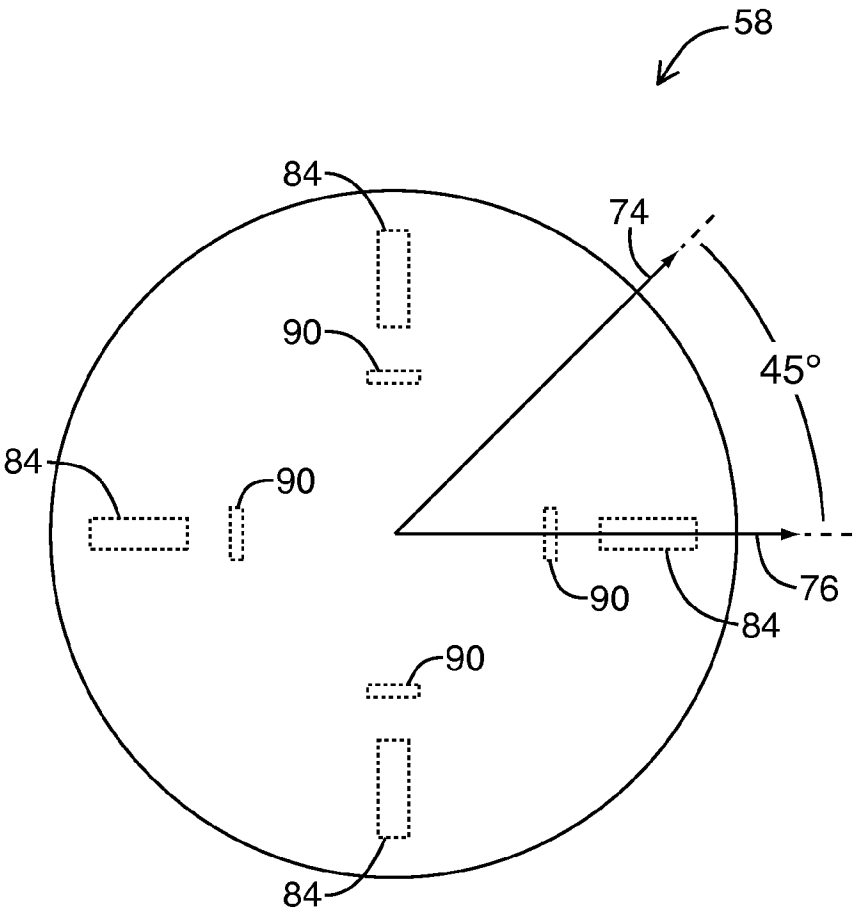
Figure 6C:
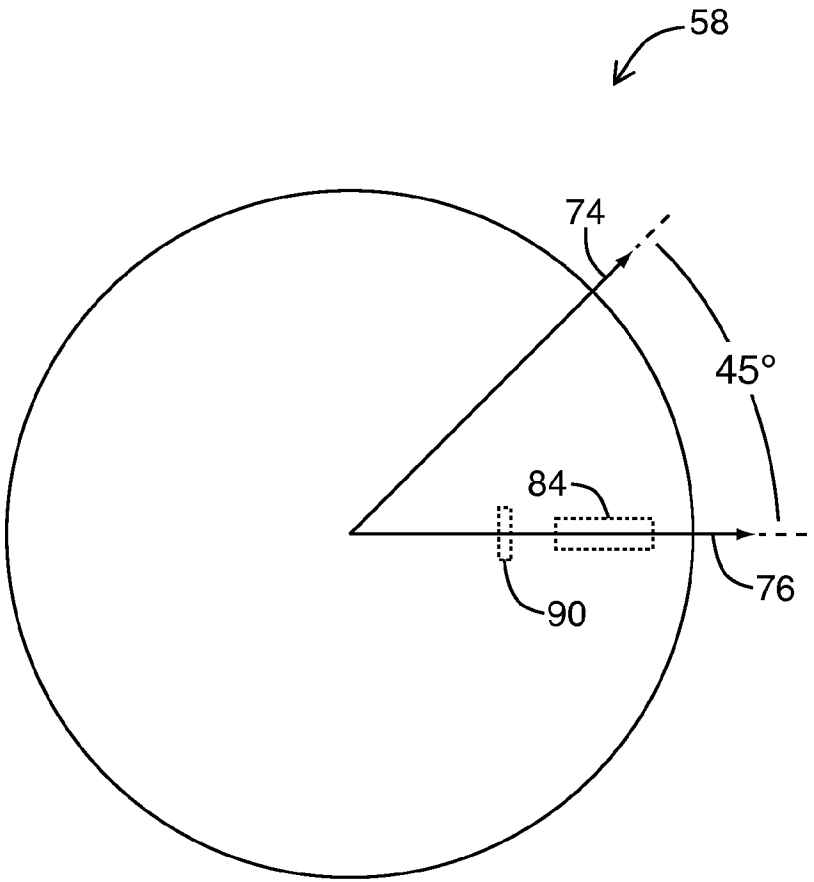

In FIG. 6C, a single radial iris 84 aligned with the characterizing vector 76 for coupling the first $TE_{22N}$ mode 70 is combined with a single transverse angular iris 90, which is also aligned with the characterizing vector 76 and therefore provides coupling of the second $TE_{22N}$ mode 72. In FIG. 6D, four such combinations of a radial iris 84 and transverse angular iris 90 are formed in the end wall 58, each combination of a radial iris 84 and transverse angular iris 90 spaced apart from each other combination within the cavity 60 by 90-degree angular offsets. Accordingly, each radial iris 84 predominantly couples the $TE_{22N}$ mode 70 and each transverse angular iris 90 predominantly couples the orthogonal $TE_{22N}$ mode 72.

Figure 6F:
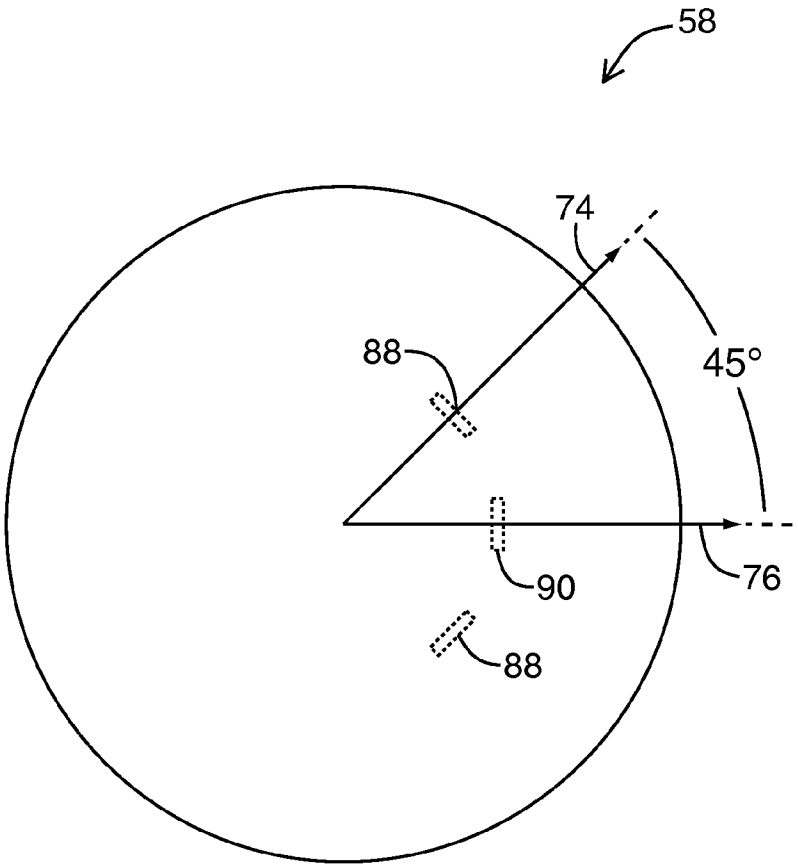
Figure 6E:
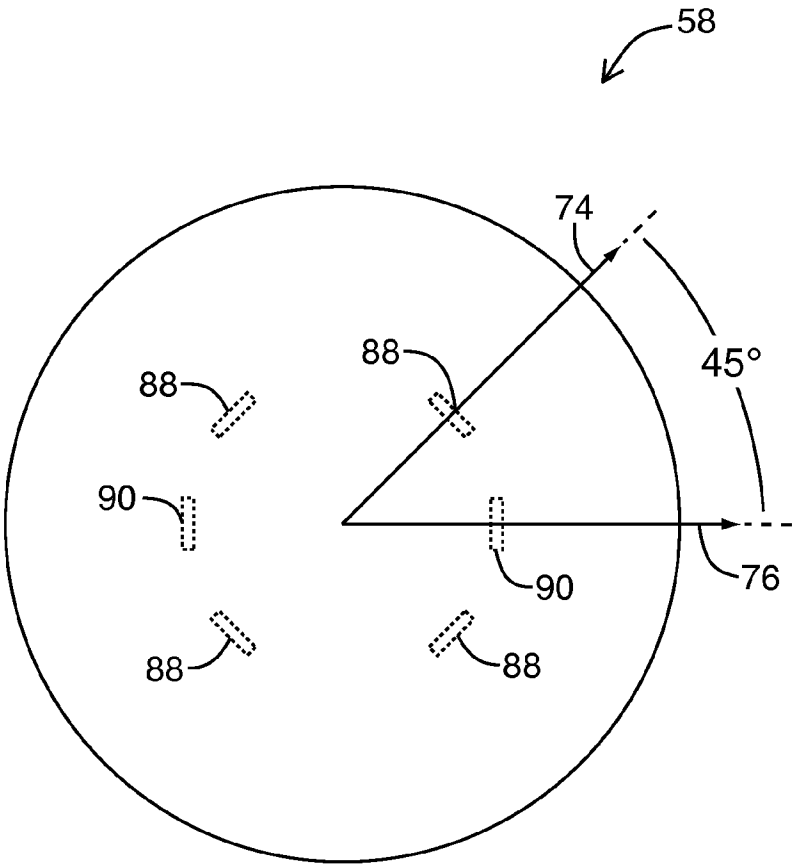

It is also possible to utilize all transverse angular irises 88 and 90, as shown in FIGS. 6E and 6F. The combination in FIG. 6E includes a pair of transverse angular irises 90 suitable for coupling the second $TE_{22N}$ mode 72, together with two pairs of transverse angular irises 88 suitable for coupling the first $TE_{22N}$ mode 70. As will be understood, each transverse angular iris 88 is located an integer multiple of 90 degrees offset in relation to the first characterizing vector 74, and likewise for each transverse angular iris 90 in relation to the second characterizing vector 76. The combination of coupling elements shown in FIG. 6F is similar to that shown in FIG. 6E, but includes only a single transverse angular iris 90 and a pair of transverse angular irises 88.

Figure 7A:
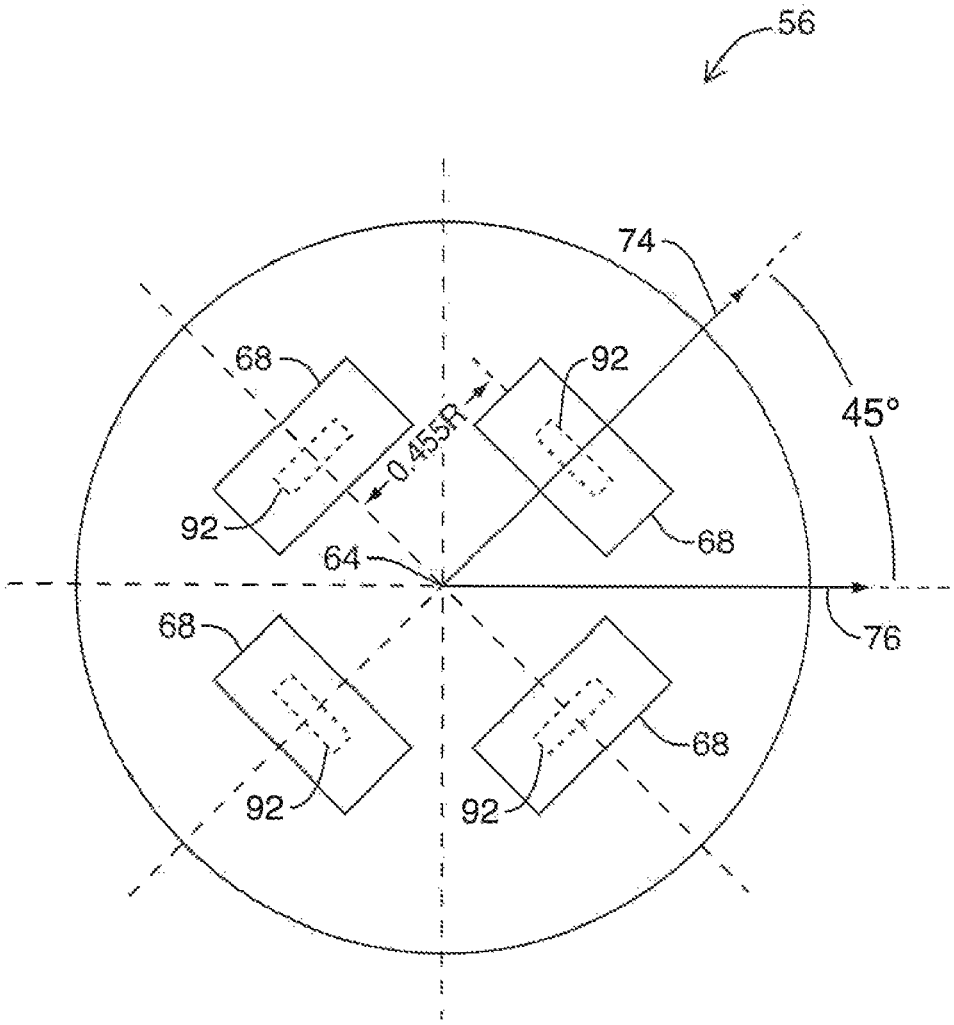
FIGS. 7A and 7B are schematic diagrams showing alternative, end-launch locations for the input port shown in FIG. 3.
Figure 7B:
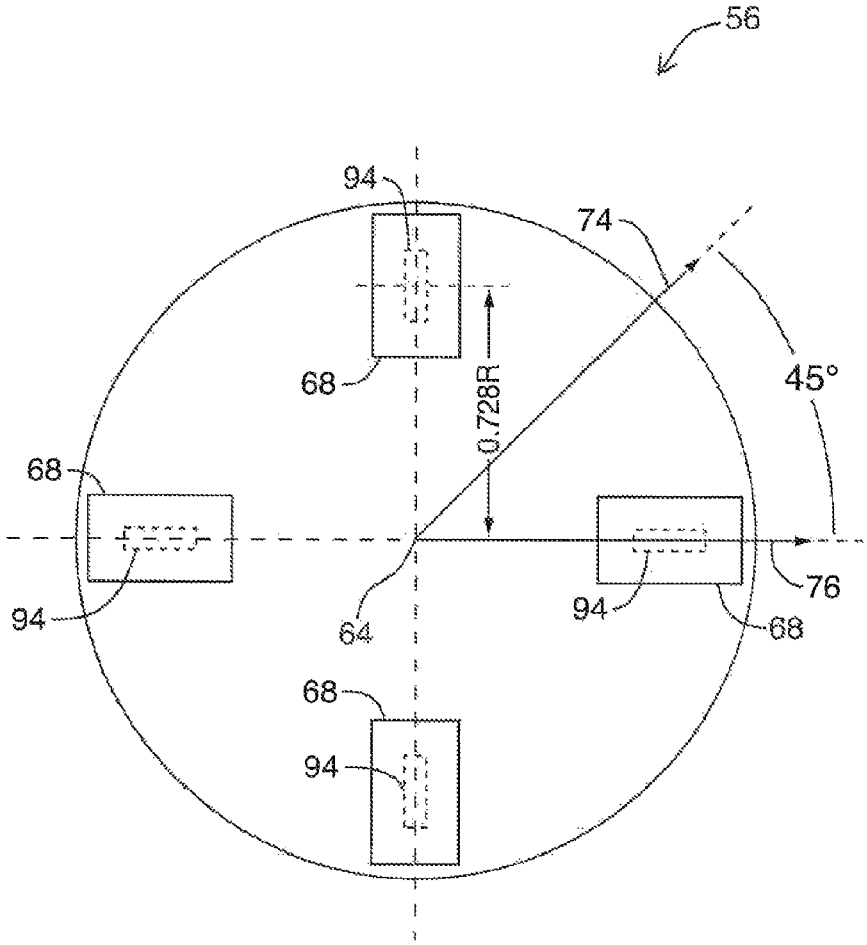

Referring now to FIGS. 7A and 7B, input coupling into the cavity 60 can also be accomplished using an input port 92 as illustrated in FIG. 7A or port 94 as illustrated in FIG. 76 formed in the end wall 56 of the cylindrical enclosure 52, as an alternative to the input port 66 formed in the sidewall 54. The locations of the input ports 92 and 94 are similar to the transverse irises 88 and radial irises 84 (FIG. 5A), but formed in the end wall 58 rather than the end wall 56. As shown in FIG. 7A, an input port 92 can be formed in the end wall 56 at a location having an angular position, in relation to the first characterizing vector 74, equal to an integer multiple of 90 degrees. The input port 92 is formed out of an elongated iris oriented generally transverse to the effective radius of the cavity 60, so that the input port 92 has predominantly an angular (as opposed to a radial) dimension, and can be spaced apart from the longitudinal axis 64 by a radial distance again as discussed in relation to the transverse angular irises 88. Thus, in some configurations of the resonator assembly 50, the centre point of the input port 92 can have a radial spacing of about 0.455R, where R is the effective radius of the cavity 60. But other radial spacings within the ranges discussed above may be suitable as well for different applications.

Now referring specifically to FIG. 7B, input coupling can alternatively be achieved using an input port 94 formed in the end wall 56 at a location having an angular position, in relation to the second characterizing vector 76, equal to an integer multiple of 90 degrees. The input port 94 is formed out of an elongated iris oriented in a generally radial direction and spaced apart from the longitudinal axis 64 by a radial distance, depending on the particular application, falling within one of the ranges discussed above in the context of the radial iris 84. In one exemplary configuration, the centre point of the input port 94 can have a radial spacing of about 0.728R, where R is the effective radius of the cavity 60.

Figure 8A:
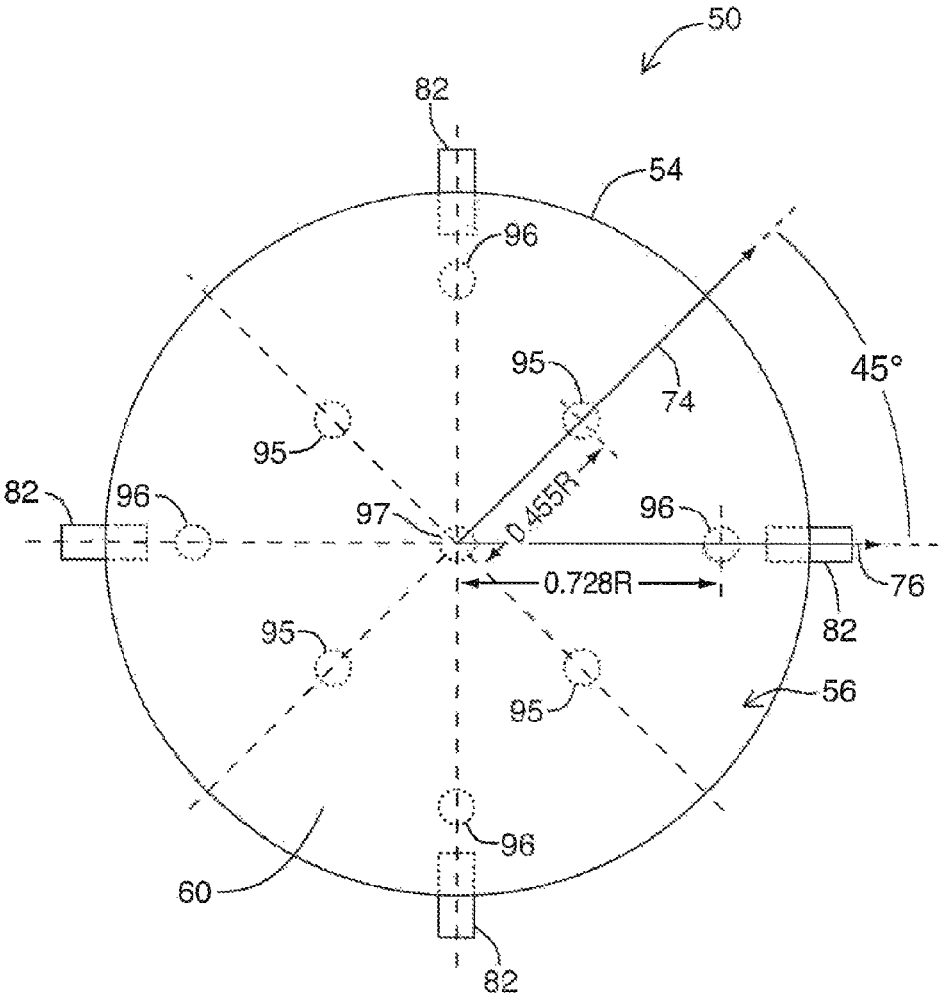
FIGS. 8A and 8B are schematic diagrams showing alternative locations for a tuning screw included in the microwave resonator assembly of FIGS. 1A and 1B.
Figure 8B:
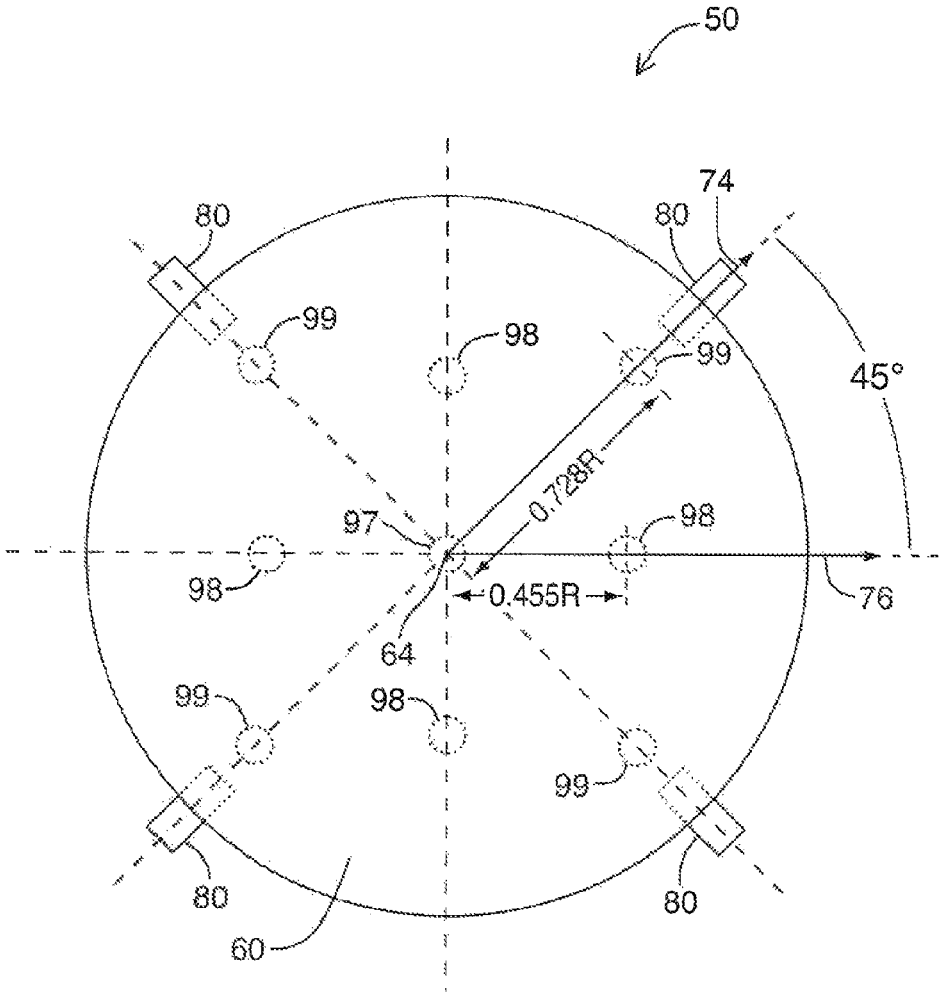

Referring now to FIGS. 8A and 8B, one or more tuning elements can be placed within the cavity 60 at different locations in order to make minor adjustments to the resonant frequencies of one or the other of the $TE_{22N}$ modes 70 and 72, or in some cases to both $TE_{22N}$ 70 and 72 modes simultaneously. As will be appreciated, the number and location of tuning elements is optimizable and may depend on the particular application or use of the microwave resonator assembly 50. At least some of the tuning elements shown in FIGS. 8A and 8B can also improve the spurious performance of the microwave resonator assembly 50, as will be explained. The tuning elements can be formed using screws or other suitable structures (e.g., rods, wall deformations and dielectric blocks) for causing small perturbations to the electromagnetic field patterns of the $TE_{22N}$ modes 70 and 72. For the sake of clarity only, reference may be made primarily to tuning screws.

To provide relatively independent tuning of the orthogonal $TE_{22N}$ modes 70 and 72, at least some of the tuning elements can be placed at locations within the cavity 60 where one of the $TE_{22N}$ modes 70 and 72 has relatively large field components as compared to the other $TE_{22N}$ mode, so that the tuning element disproportionately disturbs one of the corresponding field patterns relative to the other. As will be appreciated, the small field perturbation can incrementally adjust the corresponding $TE_{22N}$ mode's resonant frequency higher or lower, thereby "tuning" the corresponding $TE_{22N}$ mode to a selected frequency (for example, in order to place the centre frequency of a microwave bandpass filter). Although tuning elements, such as tuning screws, may be utilized to incur fine adjustments to a resonant frequency, there may be a practical limit on the degree to which that resonant frequency can be adjusted. For coarser adjustments, it may be required or preferable to re-design other dimensions of the cavity 60, such as its axial length or effective radius 62.

The tuning elements shown specifically in FIG. 8A are suitable for tuning the first $TE_{22N}$ mode 70 defined by characterizing vector 74. Tuning screws 82 may project through the side wall 54 into the interior of cavity 60, at a suitable axial height (which may depend on the value of "N") within the cavity 60, and at angular positions equal to an integer multiple of 90 degrees in relation to the second characterizing vector 76. The dimensions and penetration depth of the tuning screw 82 into the cavity 60 determine its influence on the resonant frequency of the first $TE_{22N}$ mode 70.

Alternatively, or additionally, one or more tuning screws 95 may be included in the resonator assembly 50. The tuning screws 95 project through the end wall 56 into the interior of the cavity 60, and are placed at locations having angular positions equal to an integer multiple of 90 degrees in relation to the first characterizing vector 74. The tuning screws 95 can also each be spaced from the longitudinal axis 64 of the cavity 60 by a radial distance of about 0.455R, where R is the effective radius of the cavity 60, or in one of the indicated ranges of radial spacing for the transverse angular iris 88 as describe with reference to FIG. 5A. As discussed above, within these approximate ranges and at the angular positions shown, the field components of the first $TE_{22N}$ mode 70 are relatively dense.

As a further possibility, one or more tuning screws 96 may project through the end wall 56 into the interior of the cavity 60, at angular positions equal to an integer multiple of 90 degrees in relation to the second characterizing vector 76. The tuning screws 96 can also each be spaced from the longitudinal axis 64 of the cavity 60 by a radial distance of between about 0.728R or one of the above-discussed ranges for the radial iris 84, as the field components of the first $TE_{22N}$ mode 70 are again relatively dense in these regions of the cavity 60.

Similar tuning elements are illustrated in FIG. 8B, but at locations within the cavity 60 that are suitable for tuning the second $TE_{22N}$ mode 72. Accordingly, tuning screws 80 project into the interior of the cavity 60 (at a suitable axial height based on the value of "N"), and at angular positions equal to an integer multiple of 90 degrees in relation to the first characterizing vector 74. Tuning screws 98 project through the end wall 56, spaced apart from each other by 90-degrees, at angular positions within the cavity 60 equal to an integer multiple of 90-degrees in relation to the second characterizing vector 76. Finally, tuning screws 99 project through the end wall 56 or 58 (not shown in FIG. 8B), spaced apart 90-degrees from each other, at angular positions equal to an integer multiple of 90-degrees in relation to the first characterizing vector 74. The tuning screws 98 and 99 can have the same radial spacing (or range of spacing) as tuning screws 95 and 96, respectively, shown in FIG. 8A.

A single tuning screw 97 (illustrated in both FIGS. 8A and 8B), projecting into the interior of the cavity 60 at the centre-point of the end wall 56 or 58, aligned with the longitudinal axis 64, can also be included in the microwave resonator assembly 50. Due to the radial symmetry of the cavity 60, the tuning screw 97 can be used to adjust the resonant frequencies of both the $TE_{22N}$ modes 70 and 72 simultaneously, with the amount and direction (higher or lower) of the adjustment depending on the dimensions and penetration depth into the cavity 60 of the tuning screw 97. Inclusion of the tuning screw 97 can additionally improve the spurious performance of the microwave resonator assembly 50 by pushing the resonant frequencies of adjacent, spurious modes away from the operational dual $TE_{22N}$ mode. Because the field components of each $TE_{22N}$ mode 70 and 72 are fairly small at the centre-point of the end wall 56 or 58 (see FIG. 2), tuning screw 97 will have a larger relative sifting of the resonant frequencies of other resonant modes having comparatively large field components at this point. For example, the $TM_{121}$ spurious mode is strong at the centre-point and therefore will be disproportionately affected. Tuning screw 97 can be included, for example, to supplement to the other tuning elements illustrated in FIGS. 8A and 8B and for improved spurious performance.

Figure 9A:
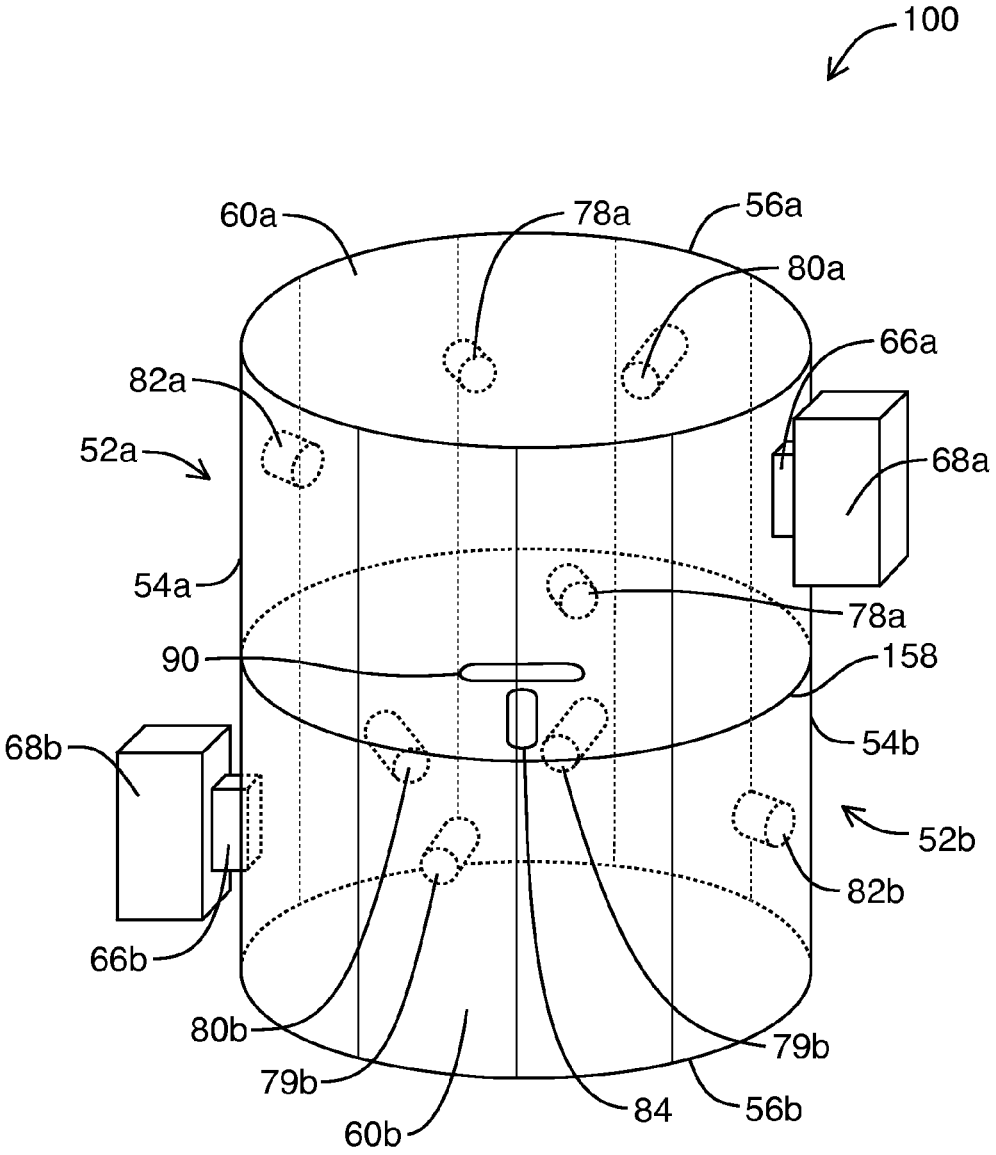
FIGS. 9A-9C are perspective, top and side views of a 4-pole microwave resonator filter constructed using the microwave resonator assembly of FIGS. 1A and 1B.
Figure 9B:
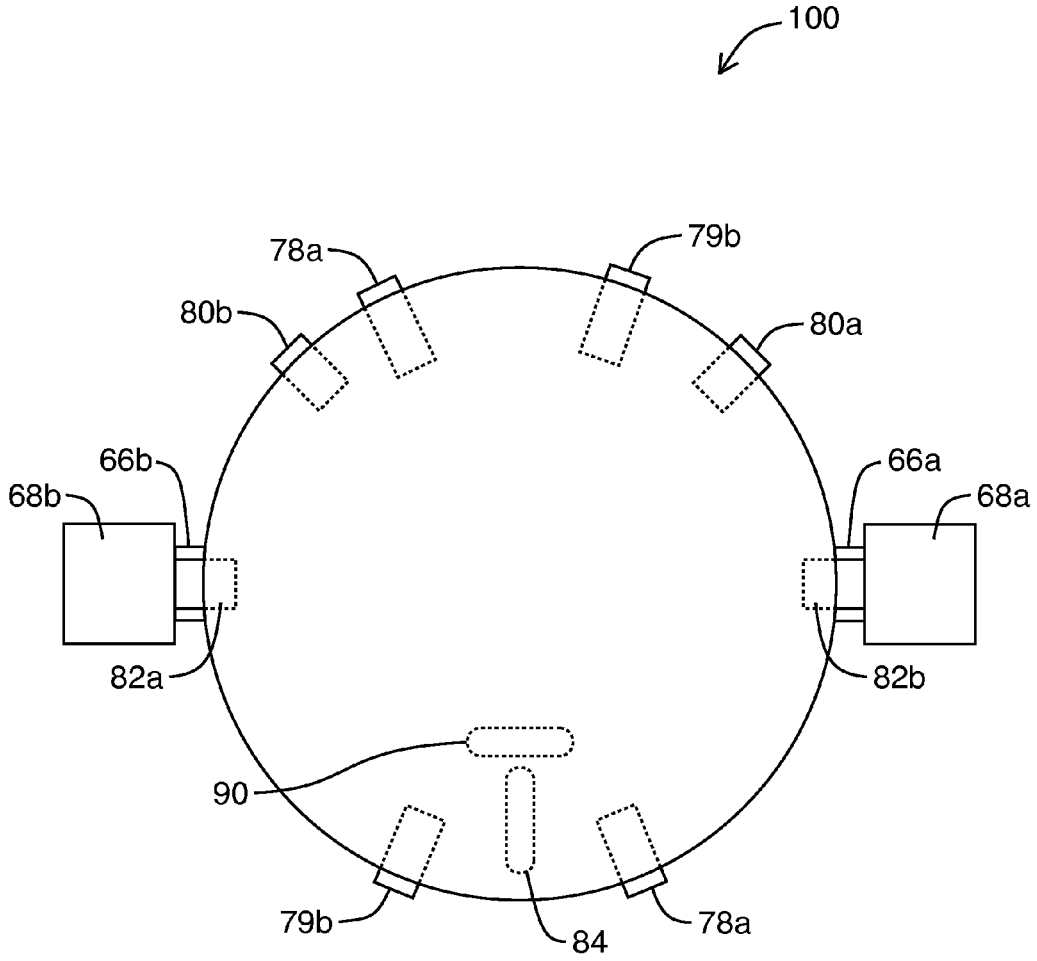
Figure 9C:
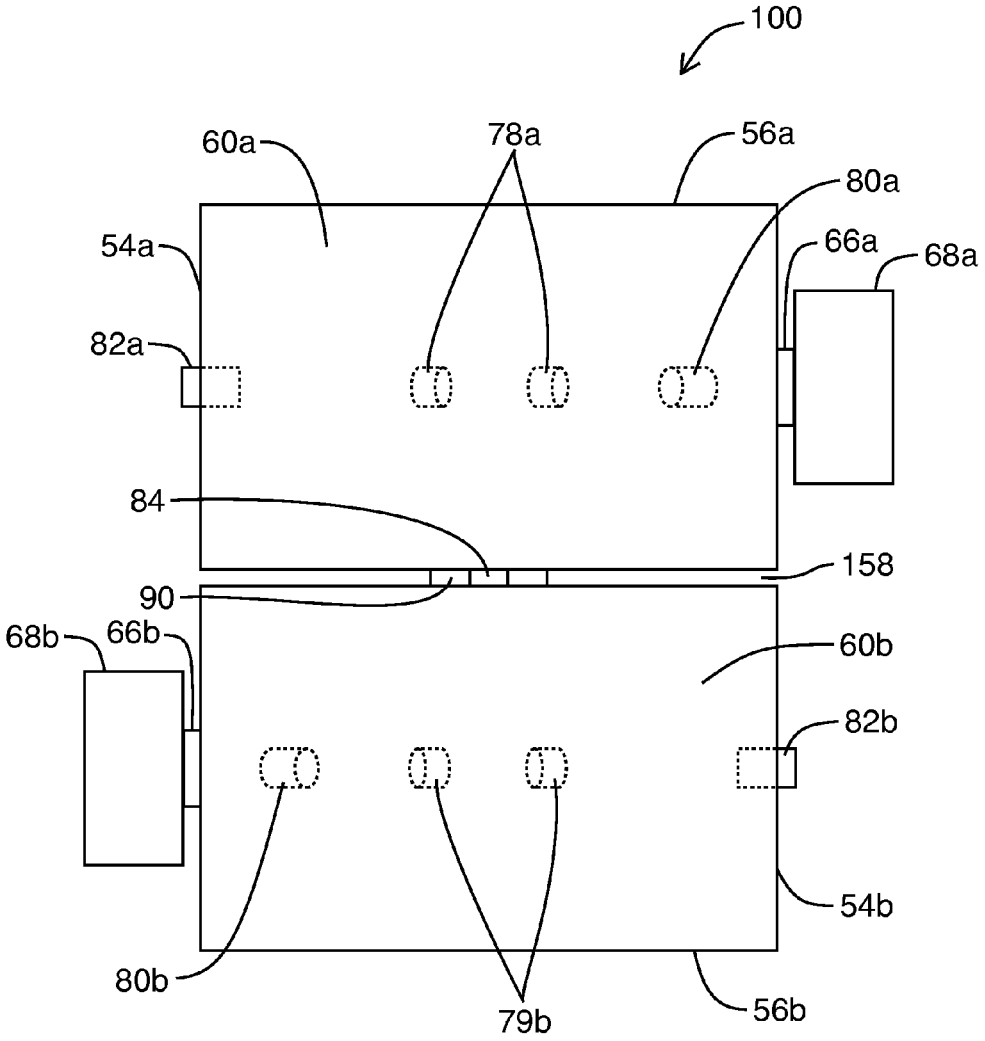

Referring now to FIGS. 9A-9C, there is illustrated a microwave resonator filter 100 in perspective, top and side views. The microwave resonator filter 100 is realized using microwave resonator assembly 50, shown in FIGS. 1A and 1B, to form a multi-cavity structure. By exciting each cavity in the dual $TE_{22N}$ mode, the microwave resonator filter 100 realizes 2 poles per cavity for an overall 4-pole filter characteristic. Of course, it should be appreciated that the microwave resonator filter 100 can be realized using any arbitrary number of cavities, in alternative configurations, to realize additional poles and higher order filters. However many cavities are included, a combination of direct and cross-coupling between adjacent cavities makes it possible to realize elliptic and Chebyshev functions. Transmission zeros are also realizable by designing the filter to incorporate negative mode coupling, either between orthogonal modes excited within a single cavity or between mutually aligned modes resonating in adjacent filter cavities. For brevity some aspects of the microwave resonator filter 100 described above in the context of the resonator assembly 50 will not be described again or may be described in less detail.

A first cylindrical enclosure 52*a* defining a first cavity 60*a* is formed out of cylindrical sidewall 54*a*, end wall 56*a* and common end wall 158. A second cylindrical enclosure 52*b* defining a second cavity 60*b* is formed out of cylindrical sidewall 54*b*, end wall 56*b* and the common end wall 158. Accordingly, the first cavity 60*a* is separated from the second cavity 60*b* by the common end wall 158 between the first and second cylindrical enclosures 52*a* and 52*b*, so that the first and second cavities 60*a* and 60*b* are adjacent and collinear (i.e., so that the first and second cavities 60*a* and 60*b* share a common longitudinal axis). While the cavities 60*a* and 60*b* are illustrated in FIGS. 9A-9C as sharing a common end wall 158 between the cylindrical enclosures 52*a* and 52, alternatively, the cavities 60*a* and 60*b* can be separated by corresponding adjacent end walls having a small air gap formed therebetween.

Input port 66*a* coupled to external waveguide section 68*a* excites a first $TE_{22N}$ mode 70 within cavity 60*a* having a first polarization defined by the first characterizing vector 74 as illustrated in FIGS. 2, 3, 4A, 4B, 5A, 5B, 6A-6F, 7A, 7B, 8A and 8B. The pair of diametrically opposed coupling screws 78*a* projecting through the sidewall 54*a* into the interior of the cavity 60*a* couple the first $TE_{22N}$ mode 70 excited in the first cavity 60*a* with a second $TE_{22N}$ mode 72 also excited in the first cavity 60*a*, the second $TE_{22N}$ mode 72 having an orthogonal polarization relative to the first $TE_{22N}$ mode 70. Tuning screws 82*a* and 80*a* optionally adjust the resonant frequencies of the first and second $TE_{22N}$ modes 70 and 72 for closer placement to a selected centre frequency of the microwave resonator filter 100.

Transverse angular iris 90 formed in the common end wall 158 between the first and second cavities 60*a* and 60*b* couples the second $TE_{22N}$ mode 72 excited in the first cavity 60*a* with a third $TE_{22N}$ mode 72 excited in the second cavity 60*b*. Simultaneously, radial iris 84 formed in the common end wall 158 couples the first $TE_{22N}$ mode 70 excited in the first cavity 60*a* with a fourth $TE_{22N}$ mode 70 excited in the second cavity 60*b*. The first and fourth $TE_{22N}$ modes have mutually aligned polarizations defined by the characterizing vector 74, while the second and third $TE_{22N}$ modes have mutually aligned polarizations defined by the characterizing vector 76.

Within the second cavity 60*b*, the pair of diametrically opposed coupling screws 79*b* projecting through the sidewall 54*b* couple together the third $TE_{22N}$ mode 72 and fourth $TE_{22N}$ mode 70 excited also in the second cavity 60*b*. As will be explained in more detail below, the angular position of the coupling screws 79*b* offset 45-degrees in relation to the coupling screws 78*a* placed in the first cavity 60*a* realizes transmission zeroes in the microwave resonator filter 100. Also, output port 66*b* is used to radiate electromagnetic energy out of the second cavity 60*b* by coupling the fourth $TE_{22N}$ mode 70 within the second cavity 60*b* with the external waveguide section 68*b*. Tuning screws 80*b* and 82*b* are optionally included to adjust the resonant frequency of the third $TE_{22N}$ mode and fourth $TE_{22N}$ mode to the selected centre frequency of the microwave resonator filter 200. As in a symmetric filter, the designation of "input" and "output" ports may be somewhat arbitrary and depend on perspective, the output port 66*b* is substantially similar to the input port 66*a* and can be formed in any of the locations illustrated in FIG. 3 (or alternatively FIGS. 7A-7B).

The particular combination of direct and cross-coupling elements shown in FIGS. 9A-9C realizes a 4-pole, cross-coupled filter. A general folded path between the input port 66*a* and output port 66*b* is formed by the successive mode coupling provided by the coupling screws 78*a* (first to second), the transverse angular iris 90 (second to third), and the coupling screws 79*b* (third to fourth). In addition to the general folded path, the radial iris 84 then provides a cross-coupled path directly between the first $TE_{22N}$ mode 70 resonating in the first cavity 60*a* and the mutually aligned fourth $TE_{22N}$ mode 70 resonating in the second cavity 60*b*. Accordingly, in the configuration shown, the transverse angular iris 90 serves as a direct coupling element, while the radial iris 84 serves as a cross-coupling element. Although it should be appreciated that the function served by these coupling elements may be reversed and depends on their angular position in relation to the characterizing vectors 74 and 76, as herein described. Moreover, the term "direct coupling element" as used herein can refer to any element that provides coupling between two successive modes in the general folded path (e.g., second and third), while the term "cross coupling element" can refer to any element that provides coupling between two non-successive (e.g., first and fourth) modes in the general folded path.

It should also be appreciated that, as an alternative to the cross-coupled filter configuration shown in FIGS. 9A-9C, a general folded filter configuration (without cross-coupling) is also realizable by omitting the cross-coupling element, in this case the radial iris 84. With no cross-coupled path directly between the first and fourth $TE_{22N}$ modes 70, the remaining coupling elements (i.e., coupling screws 78*a*, transverse angular iris 90, and coupling screws 79*b*) realize the general folded path between the input port 66*a* and output port 66*b* by coupling the first, second, third and fourth modes successively.

Principles of microwave filter design may be utilized in order to determine the number, type, location and size of the coupling elements included in the microwave filter 100. For example, a transfer function for the microwave filter 100 can be calculated, usually by selecting a filter type (elliptic, Chebyshev, etc.), and then calculating poles and zeros of the transfer function that will realize a specified set of performance criteria, such as insertion loss, return loss, passband ripple, stopband ripple, bandwidth, isolation. Often the specified performance criteria will be interrelated to the order of the microwave filter 100, so that either the selected criteria will dictate a minimum required filter order or, alternatively, if the filter order (e.g., 4-poles, 8-poles, etc.) is fixed, constraints may then be imposed on the realizable performance criteria. As will be appreciated, the design process can be iterative requiring multiple formulations until an acceptable transfer function is designed. Design software may be of assistance throughout the process.

After synthesizing the filter transfer function, a variety of different techniques can then be used to realize a physical microwave resonator (e.g., microwave resonator filter 100) that exhibits the synthesized transfer characteristics. One such technique involves formulating a coupling matrix (usually designated "M") from the synthesized transfer function. As will be appreciated, the entries in the coupling matrix M specify the magnitude and sign of coupling required between each resonator included in the microwave resonator filter 100 to realize the synthesized transfer function. Once the coupling matrix has been formulated, physical dimensions for the microwave filter can be solved that provide the required couplings. Of course, it is possible that not every synthesized transfer function will be physically realizable. For example, cross-coupling between two non-successive resonators (or even between successive resonators) may be required that cannot easily be realized. The physical realization stage of the design process may be iterative as well, and it may be necessary to reformulate the filter transfer function subject to physical constraints as well as performance criteria.

Assuming a realizable transfer function has been synthesized, the coupling elements included in the microwave resonator filter 100 can be selected and configured to meet the requirements of the coupling matrix M. In terms of coupling the first $TE_{22N}$ mode 70 and second $TE_{22N}$ mode 72 excited in the first cavity 60*a*, the number and respective sizing of coupling screws 78*a* (as well as angular position) can be varied to meet the requirement. Similarly, in terms of coupling the third $TE_{22N}$ mode 72 and fourth $TE_{22N}$ mode 70 excited in the second cavity 60*b*, the number and respective sizing of coupling screws 79*b* (as well as angular position) can be varied to meet the requirement. In general, increasing the size and number of coupling elements will increase the amount of coupling provided. Depending on whether transmission zeros are to be created, coupling screws having the same or different polarity of coupling can be used in the cavities 60*a* and 60*b*. In the exemplary configuration shown, the coupling screws have opposite polarities to create transmission zeros.

A similar process can be followed to size the coupling elements formed in the common end wall 158 for radiating energy between the two cavities 60*a* and 60*b*. The number and relative sizing of radial irises 86 and/or transverse angular irises 90 (FIG. 5B) can be varied until the required coupling between the mutually aligned second and third $TE_{22N}$ modes 72 excited in the first and second cavities 60*a* and 60*b*, respectively, is achieved. If cross-coupling between the first and fourth $TE_{22N}$ modes 70 is also prescribed by the coupling matrix M, then the number and relative sizing of radial irises 84 and/or transverse angular irises 88 (FIG. 5A) can be varied until the required coupling is realized. The illustrative combinations presented in FIG. 6 represent just some of the possible ways in which to realize different amounts and direct and cross-coupling of modes in the microwave resonator filter 100. Design software can again be of assistance in the process of sizing the different coupling elements.

The microwave resonator filter 100 is configurable based on the selection of intra or inter cavity coupling elements to realize two transmission zeros, thereby creating an overall symmetric filter function. Coupling of the first $TE_{22N}$ mode 70 to the second $TE_{22N}$ mode 72 within cavity 60*a* is achieved using one or more of the coupling screws 78, while coupling of the third $TE_{22N}$ mode 72 to the fourth $TE_{22N}$ mode 70 within cavity 60*b* is achieved using one or more of the coupling screws 79, which are 45-degrees offset from the coupling screws 78. When coupling screws 78 are included in cavity 60*a* and coupling screws 79 are included in cavity 60*b* (or vice versa), the respective couplings in each cavity 60*a* and 60*b* have opposite polarities, or are disposed in an anti-symmetrical relationship in relation to each other, resulting in the creation of the transmission zeros. On the other hand, transmission zeros can be avoided by placing coupling screws 78 (or equivalently coupling screws 79) in each cavity 60*a* and 60*b*, so that the respective couplings have the same polarity (whether positive or negative) and therefore do not form an anti-symmetrical relationship.

Figure 10A:
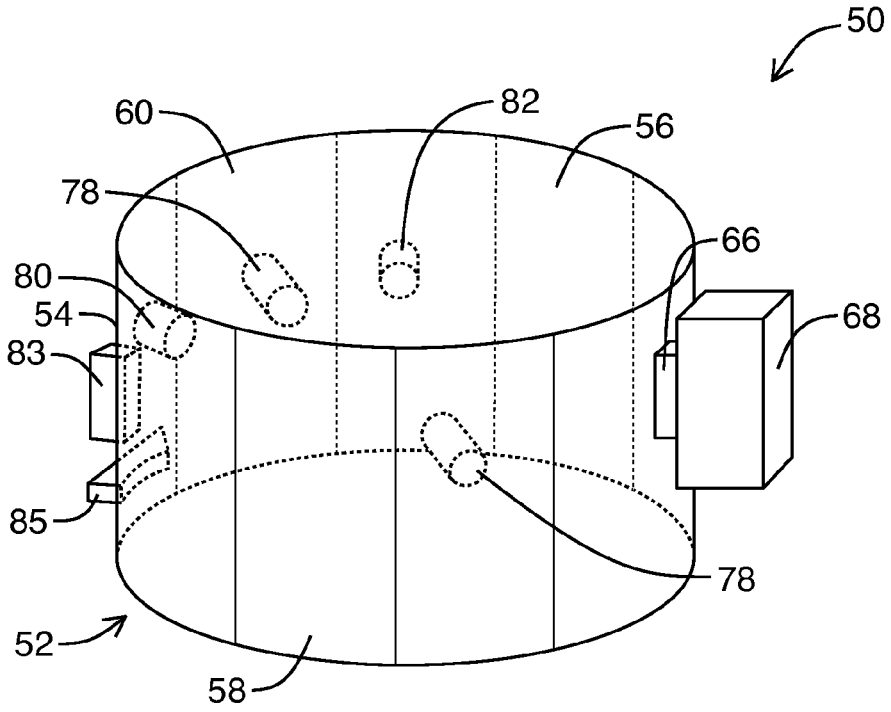
FIGS. 10A and 10B are perspective and top views of an alternative configuration of the microwave resonator assembly of FIGS. 1A and 1B having sidewall mounted coupling elements.
Figure 10B:
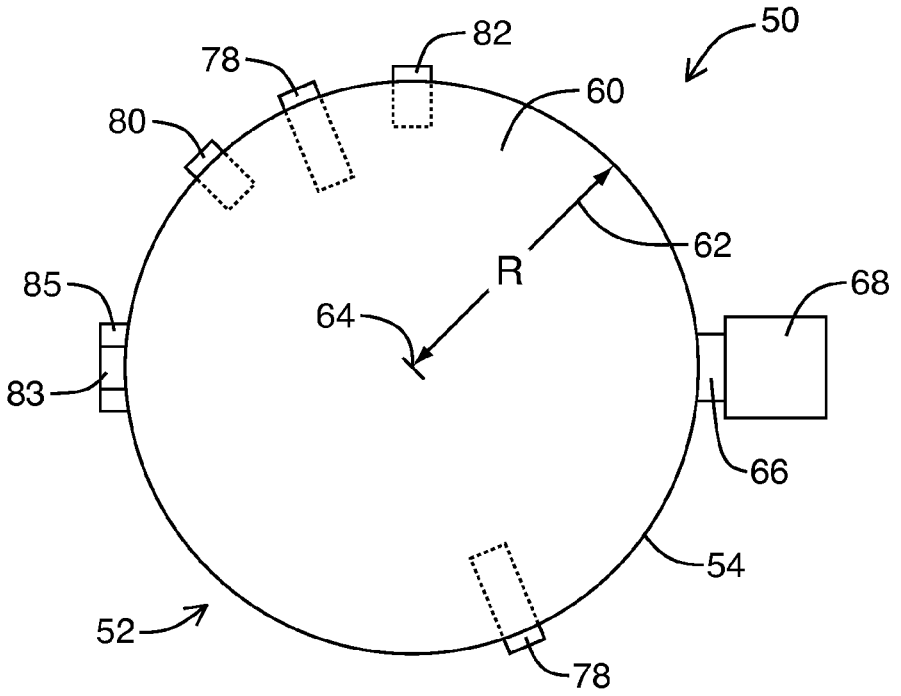

Referring now to FIGS. 10A and 10B, in an alternate configuration of the resonator assembly 50, coupling elements are formed in the sidewall 54 of the cylindrical enclosure 52 (as opposed to the end well 58 of FIG. 10A) to make the microwave resonator assembly 50 suitable for inclusion in a planar-mounted microwave filter. The configuration of microwave resonator assembly 50 shown in FIGS. 10A and 10B is similar in some respects to that shown in FIGS. 1A and 1B. For the sake of clarity, discussion of like or analogous elements may be somewhat abbreviated while differences may be emphasized.

A cavity 60 is again defined by a cylindrical enclosure 52 formed out of sidewall 54 extending between opposing end walls 56 and 58. Input port 66 couples electromagnetic energy radiated by external waveguide section 68 into the cavity 60, inside which a first $TE_{22N}$ mode 70 having a first polarization (defined by characterizing vector 74) is excited. At least one discontinuity is formed within the cavity 60, for example using coupling screws 78 or 79 (not shown in FIG. 10A to 10B), to couple the first $TE_{22N}$ mode 70 with a second $TE_{22N}$ mode 72 having a second field polarization orthogonal to that of the first $TE_{22N}$ mode 70. Tuning screw 82 is used to make small adjustments to the resonant frequency of the first $TE_{22N}$ mode 70; tuning screw 80 serves the same function for the second $TE_{22N}$ mode 72.

However, rather than forming coupling elements in the end wall 58 for radiating electromagnetic energy out of the cavity 60 (e.g., into an adjacent cavity for realizing a multi-cavity microwave filter), coupling elements are instead formed in the sidewall 54. As illustrated in FIGS. 10A and 10B, when located at angular positions within the cavity 60 equal to an integer multiple of 90-degrees in relation to the second characterizing vector 76, longitudinal iris 83 couples the first $TE_{22N}$ mode 70 predominantly while coupling the second $TE_{22N}$ mode 72 to a comparatively less degree. In this respect, the longitudinal iris is similar to the radial iris 84 (FIG. 5A). Once the input port 66 fixes the polarization of the first $TE_{22N}$ mode 70, any of four equivalent locations in the sidewall 54, spaced 90-degrees apart from each other, can be used to radiate the first $TE_{22N}$ mode 70 out of the cavity 60 using the longitudinal iris 83.

Transverse angular iris 85 is shown in FIGS. 10A and 10B formed in the side wall 54 in close proximity to, and at the same angular position as, the longitudinal iris 83. At that angular position within the cavity 60, transverse angular iris 85 couples the second $TE_{22N}$ mode 72 and couples the first $TE_{22N}$ mode 70. The degree of coupling of the second $TE_{22N}$ mode 72 by the transverse angular iris 85 is greater than the coupling of the first $TE_{22N}$ mode 72. But again due to the 90-degree radial symmetry of the cavity 90, the angular position of the transverse angular iris 85 is not fixed and can equal any integer multiple of 90-degrees in relation to the second characterizing vector 76. In this regard, the transverse angular iris 85 is similar to the transverse angular iris 90 (FIG. 5B). While it is not strictly necessary for the longitudinal iris 83 to have the same angular position as the transverse angular iris 85 within the cavity 60, locating these two coupling elements at the same angular position (as will be seen) can facilitate design of a two-cavity, planar mounted microwave filter. Of course, if three or more cavities are included in the microwave filter, then other relative angular positions for the longitudinal iris 83 and transverse angular iris 85 may be apparent.

Figure 11A:
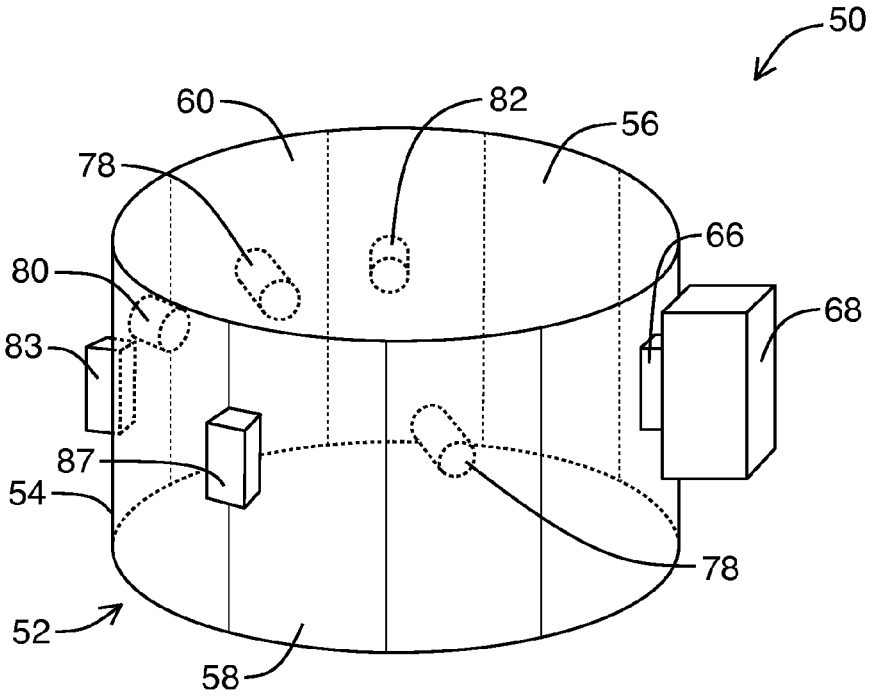
FIGS. 11A and 11B are perspective and top views of another alternative configuration of the microwave resonator assembly of FIGS. 1A and 1B having sidewall mounted coupling elements.
Figure 11B:
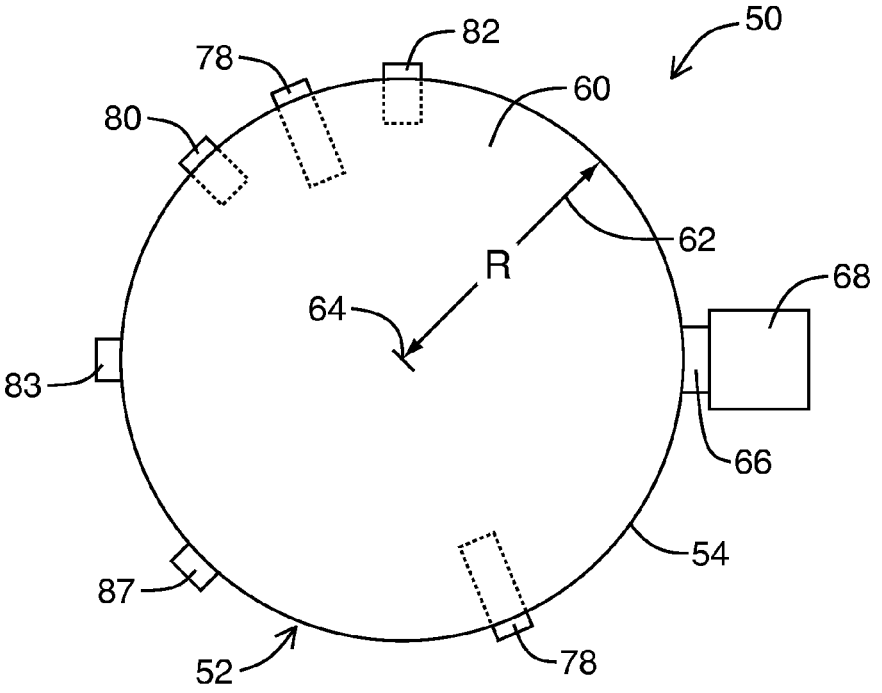

Referring now to FIGS. 11A and 11B, in yet another alternate configuration of the microwave resonator assembly 50, the transverse angular iris 85 shown in FIGS. 10A and 10B can be replaced with a second longitudinal iris 87 located at a 45-degree angular offset, in relation to the longitudinal iris 83 as illustrated in FIGS. 11A and 11B, plus in some cases an integer multiple of 90 degrees. Accordingly, similar to the radial iris 86 (FIG. 5B), the longitudinal iris 87 can be located within the cavity 60 at an angular position equal to an integer multiple of 90-degrees in relation to the first characterizing vector 74. Any of the four locations within the cavity 60 satisfying this relationship will provide good coupling of the second $TE_{22N}$ mode 72. Although as will be seen, preserving a 45-degree angular between the longitudinal irises 83 and 87 can facilitate design of a two-cavity, planar mounted microwave filter.

Figure 12A:
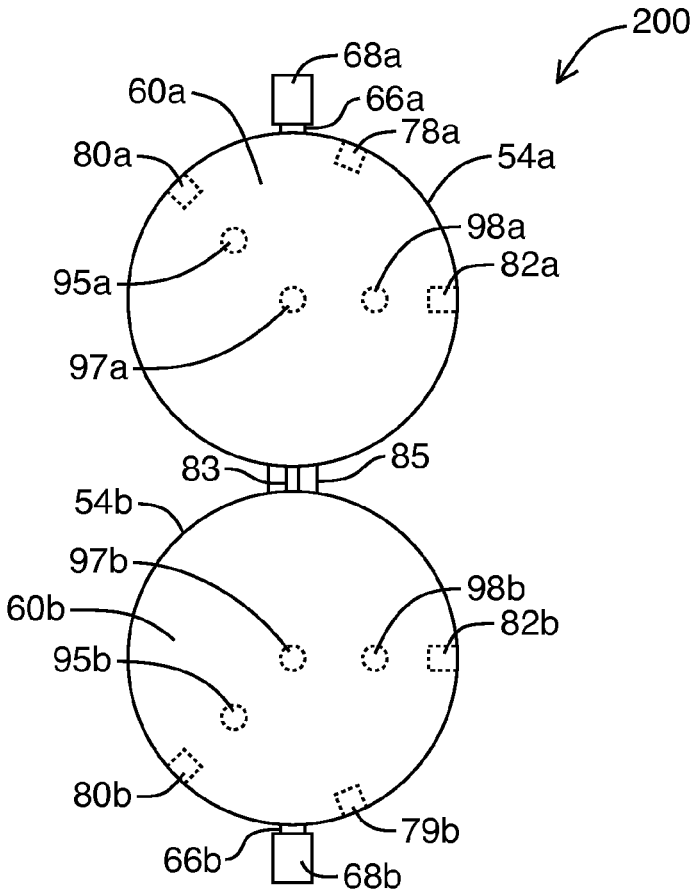
FIGS. 12A and 12B are top and perspective views of a 4-pole, planar-mounted microwave resonator filter constructed using the microwave resonator assembly of FIGS. 10A and 10B.
Figure 12B:
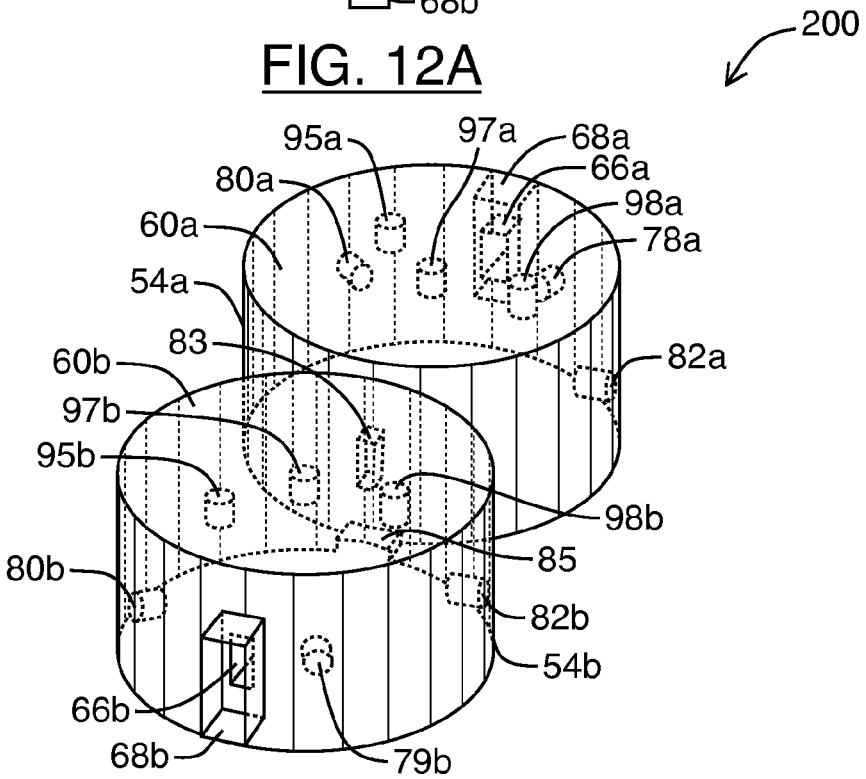

Referring now to FIGS. 12A and 12B, there is illustrated a microwave resonator filter 200 in perspective and top views. The microwave resonator filter 200 is realized using the microwave resonator assembly 50, shown in FIGS. 10A and 10B, which through inclusion of sidewall coupling elements is suitable for constructing a planar-mounted, microwave filter. Again by operating in the dual $TE_{22N}$ mode, the microwave resonator filter 200 realizes 2 poles in each of two adjacent cavities for an overall 4-pole bandpass characteristic. Of course, additional cavities can be included to realize additional poles in the filter function. A combination of direct and cross-coupling of modes resonating in adjacent cavities makes it possible to realize a variety of different linear filter functions, such as elliptic and Chebyshev filter functions, as well as other functions. Transmission zeros are also realizable through the use of negative mode coupling. For the sake of clarity, discussion of certain aspects shared in common by the two microwave resonator filters 100 and 200 may be abbreviated while differences may be highlighted.

A first cavity 60*a* is formed in close lateral proximity to a second cavity 60*b*, so that corresponding adjacent portions of the cylindrical sidewalls 54*a* and 54*b*, as illustrated in FIG. 12A, separate the two cavities 60*a* and 60*b*. In some cases, a small arcuate portion of the cylindrical sidewalls 54*a* and 54*b* can be shared between the first and second cavities 60*a* and 60*b* to form a common sidewall portion (not shown). However, a small air gap can alternatively be formed between the corresponding adjacent portions of sidewalls 54*a* and 54*b*, provided the inter-cavity separation is relatively short (e.g., to maintain good coupling between the two cavities 60*a* and 60*b*). In this arrangement, the first and second cavities 60*a* and 60*b* have respective longitudinal axes (not explicitly shown) that are parallel, but non-collinear.

Input port 66*a* coupled to external waveguide section 68*a* excites a first $TE_{22N}$ mode 70 within cavity 60*a* having a first polarization defined by the first characterizing vector 74. The pair of diametrically opposed coupling screws 78*a* projecting through the sidewall 54*a* couple the first $TE_{22N}$ mode 70 excited in the first cavity 60*a* with a second $TE_{22N}$ mode 72 excited in cavity 60*a* and having an orthogonal field polarization relative to the first $TE_{22N}$ mode 70. Tuning screws 82*a* and 95*a* are optionally included to adjust the resonant frequency of the first $TE_{22N}$ mode 70 to a selected centre frequency of the microwave resonator filter 200. Likewise tuning screws 80*a* and 98*a* are optionally included adjust the resonant frequency of the second $TE_{22N}$ mode 72 also to the selected centre frequency.

As shown in FIGS. 12A and 12B, transverse angular iris 85 couples the second $TE_{22N}$ mode 72 excited in the first cavity 60*a* with a mutually aligned third $TE_{22N}$ mode 72 excited in the second cavity 60*b*. Simultaneously, longitudinal iris 83 couples the first $TE_{22N}$ mode 70 excited in the first cavity 60*a* with a mutually aligned fourth $TE_{22N}$ mode 70 excited in the second cavity 60*b*. Coupling screw 79*b* then couples together the third $TE_{22N}$ mode 72 and fourth $TE_{22N}$ mode 70 excited in the second cavity 60*b*, and output port 66*b* is used to radiate electromagnetic energy out of the second cavity 60*b* by coupling the fourth $TE_{22N}$ mode 70 with the external waveguide section 68*b*. Tuning screws 80*b* and 98*b* are optionally included to adjust the resonant frequency of the third $TE_{22N}$ mode 72 to the selected centre frequency of the microwave resonator filter 200, as are tuning screws 82*b* and 95*b* for the same purpose in relation to the fourth $TE_{22N}$ mode 70. Screws 97*a* and 97*b* are optionally included to improve the spurious free range of the microwave resonator filter 200.

The respective dimensions and axial positioning of the longitudinal iris 83 and the transverse angular iris 85 are optimizable to adjust the coupling provided by each iris as specified in the coupling matrix M. For example, the longitudinal axis 83 can be located at or near a maximum in the axial field pattern of the $TE_{22N}$ mode (i.e., at an odd multiple of quarter-wavelengths in the axial direction) to provide strong coupling of the first and fourth $TE_{22N}$ modes 70, but also at other axial positions depending on the application. The transverse angular iris 85 can then be located vertically adjacent the longitudinal axis 83 in space remaining in the sidewall 54. As shown in FIG. 12B, the transverse angular iris 85 abuts the end wall 58, but other locations are possible as well.

Figure 13A:
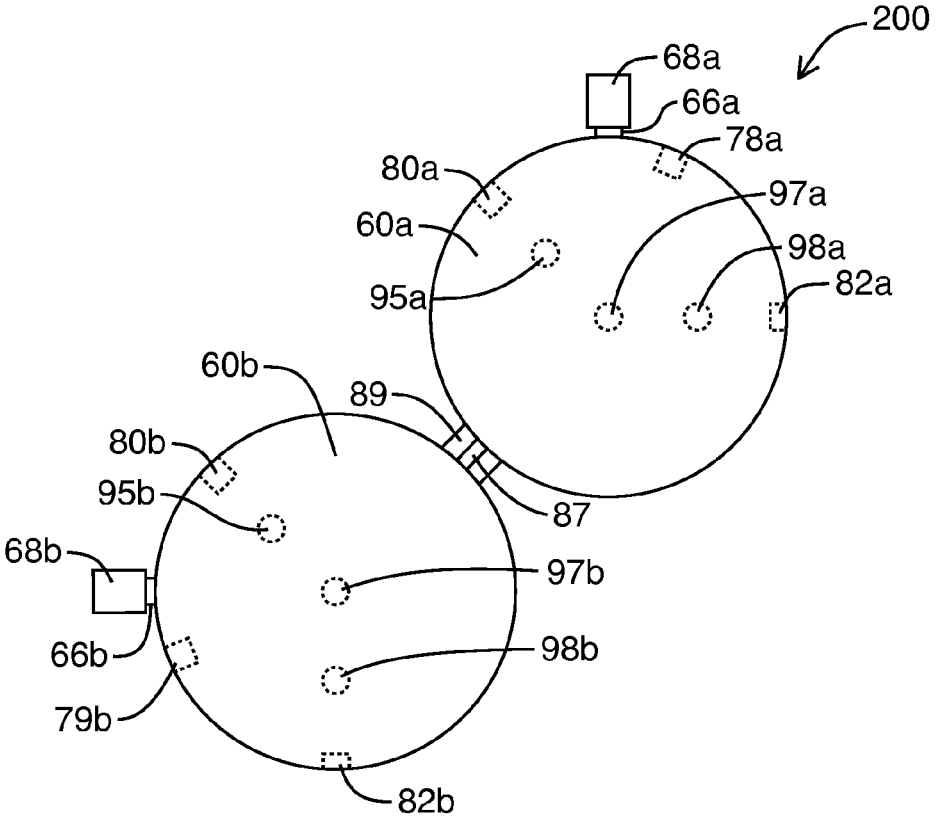
FIGS. 13A and 13B are top and perspective views of an alternative configuration of a 4-pole, planar-mounted microwave resonator filter constructed using the microwave resonator assembly of FIGS. 10A and 10B.
Figure 13B:
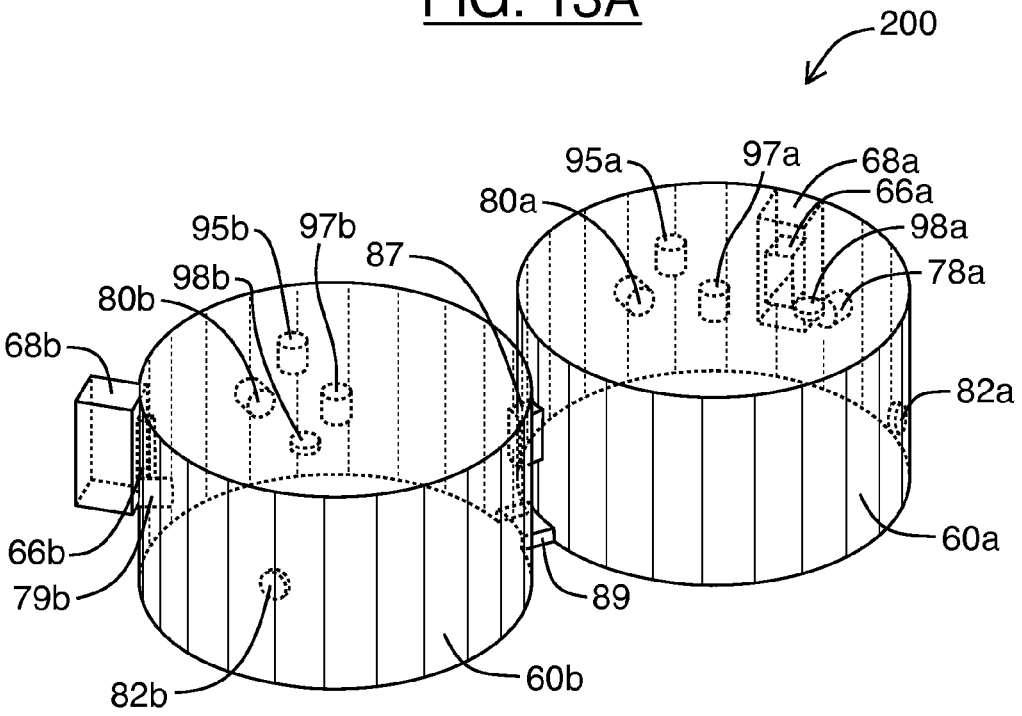

The respective couplings of the longitudinal iris 83 and transverse angular iris 85, as illustrated in FIGS. 12A and 12B, are related to their angular position within the cavity 60*a* (or equivalently within the cavity 60*b*). Referring now to FIGS. 13A and 13B, for example, by undergoing a 45-degree translation relative to the configuration seen in FIGS. 12A and 12B, the longitudinal iris 87 now couples the second and third $TE_{22N}$ modes 72, while the transverse angular iris 89 couples the first and fourth $TE_{22N}$ modes 70. Intermediate angles between these two extremes are possible as well, in which case the inter-cavity coupling elements would be offset an integer multiple of 90-degrees from some intermediate vectors between the first or second characterizing vectors 74 and 76. At this intermediate angle, each of the longitudinal iris 87 and the transverse angular iris 89 would provide some non-negligible coupling of the first and fourth $TE_{22N}$ modes 70, as well as some non-negligible coupling of the second and third $TE_{22N}$ modes 72. It should be understood, however, that the angle between the longitudinal iris 87 and the transverse angular iris 89 can remain 45-degrees. Depending on the particular application, any offset angle in relation to the characterizing vectors 74 and 76 may be prescribed. Accordingly, the relative spacing and angular positions of these coupling elements are optimizable to realize different filter functions in the microwave resonator filter 200. Tuning screw 95*a* is optionally included to adjust the resonant frequency of the first $TE_{22N}$ mode 70 to a selected centre frequency of the microwave resonator filter 200. Likewise, tuning screw 98*a* is optionally included to adjust the resonant frequency of the second $TE_{22N}$ mode to the selected center frequency. Tuning screw 98*b* is optionally included to adjust the resonant frequency of the third $TE_{22N}$ mode 72 to the selected centre frequency of the microwave resonator filter 200, and tuning screw 95*b* is optionally included for the same purpose in relation to the fourth $TE_{22N}$ mode 70. Screws 97*a* and 97*b* are optionally included to improve the spurious free range of the microwave resonator filter 200.

Figure 14A:
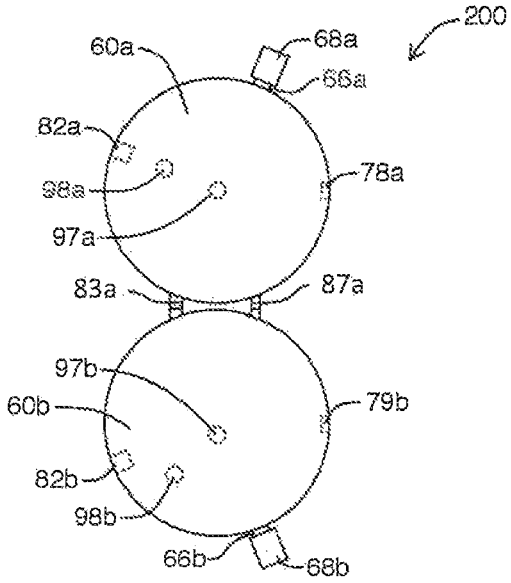
FIGS. 14A and 14B are top and perspective views of a 4-pole, planar-mounted microwave resonator filter constructed using the microwave resonator assembly of FIGS. 11A and 11B.
Figure 14B:
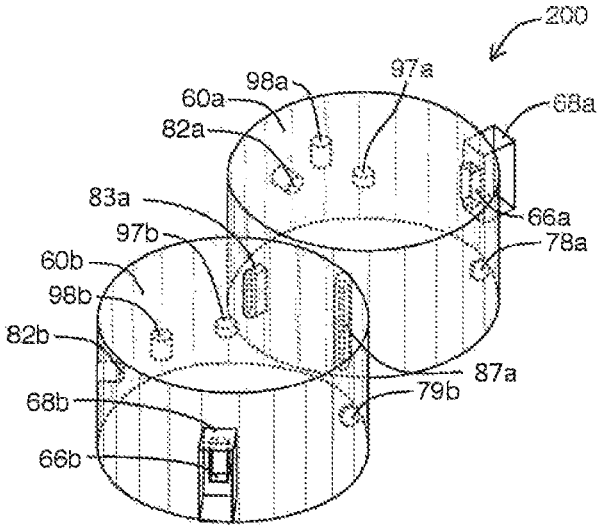

Referring now to FIGS. 14A and 14B, in an alternative configuration of the microwave resonator filter 200, a pair of longitudinal irises 83*a* and 87*a* is used to couple the first and second cavities 60*a* and 60*b*. The resonant modes coupled by each longitudinal iris 83*a* or 87*a* (as well as the relative strengths of these couplings) are related to the angular position of the respective coupling element within the cavities 60*a* and 60*b*. The longitudinal iris 83*a*, being diametrically opposed to the input port 66*a* (and hence an integer multiple of 90-degrees offset from the second characterizing vector 76), predominantly but not exclusively couples the first and fourth $TE_{22N}$ modes 70. Likewise the longitudinal axis 87*a*, being 45-degrees offset from the longitudinal axis 83*a* (and hence an integer multiple of 90-degrees offset from the first characterizing vector 74), predominantly but not exclusively couples the second and third $TE_{22N}$ modes 72. Tuning screw 98*a* is optionally included to adjust the resonant frequency of the second $TE_{22N}$ mode to the selected center frequency of the microwave resonator filter 200, and tuning screw 98*b* is optionally included for the same purpose but to adjust the resonant frequency of the third $TE_{22N}$ mode 72 to the selected centre frequency. Screws 97*a* and 97*b* are optionally included to improve the spurious free range of the microwave resonator filter 200.

Although not explicitly illustrated, the relative couplings provided by the longitudinal irises 83 and 87 would be opposite to that provided by the exemplary configuration shown in FIGS. 14A and 14B. If the longitudinal iris 87 were instead to be located diametrically opposed to the input port 66*a*, then it would be the longitudinal iris 87 coupling the first and fourth $TE_{22N}$ modes 70 and the longitudinal iris 83 coupling the second and third $TE_{22N}$ modes 72. Again the longitudinal irises 83 and 87 can be formed at angular positions equal to an integer multiple of 90-degrees offset from some intermediate vectors between the first and second characterizing vectors 74 and 76, thereby adjusting the relative couplings of each orthogonal mode to suit the application.

Some combinations of the longitudinal iris 83 with the longitudinal iris 87 will also realize transmission zeros in the filter characteristic of the microwave resonator filter 200. The polarity of the coupling provided by the longitudinal irises 83 and 87 can depend on the size of the iris in relation to the free-space wavelength of the resonance modes being coupled together. For example, if the major dimension (i.e., axial length) of the longitudinal iris 83 or 87 is less than one half of the free-space wavelength, the resulting coupling will have a certain polarity. But coupling of the opposite polarity will result if the major dimension of the longitudinal iris 83 or 87 is greater than one half of the free-space wavelength. By sizing the axial lengths of the longitudinal irises 83 and 87 in relation to one half-wavelength, the couplings provided by each respective iris 83 and 87 can be made to have opposite polarities and relative magnitudes, as specified by the M matrix, such that transmission zeros are created. For example, the length of one longitudinal iris (e.g., 83) can be less than one half-wavelength, while the length of the other longitudinal iris (e.g., 87) can be larger than one half-wavelength. By adjusting the relative dimensions of the two longitudinal irises 83 and 87, depending on the application, to provide the specified couplings, the transmission zeros can be realized.

In an alternative configuration of the resonator assembly 50 not explicitly illustrated, the longitudinal irises 83 and 87 can be sized to be both smaller or both larger than one half of the free-space wavelength. In either case, both smaller or both larger, the relative couplings provided by the longitudinal irises 83 and 87 will have the same polarity, positive or negative. It is not necessary for the longitudinal irises to have the same axial length and can be sized differently, depending on the particular application, to provide different relative couplings. In these configurations, transmission zeros can be created in the microwave filter 200 instead by the relative angular positions of the coupling screws 78 and 79 placed in each cavity 60*a* and 60*b*, as described above with reference to FIGS. 4A and 4B.

Figure 15A:
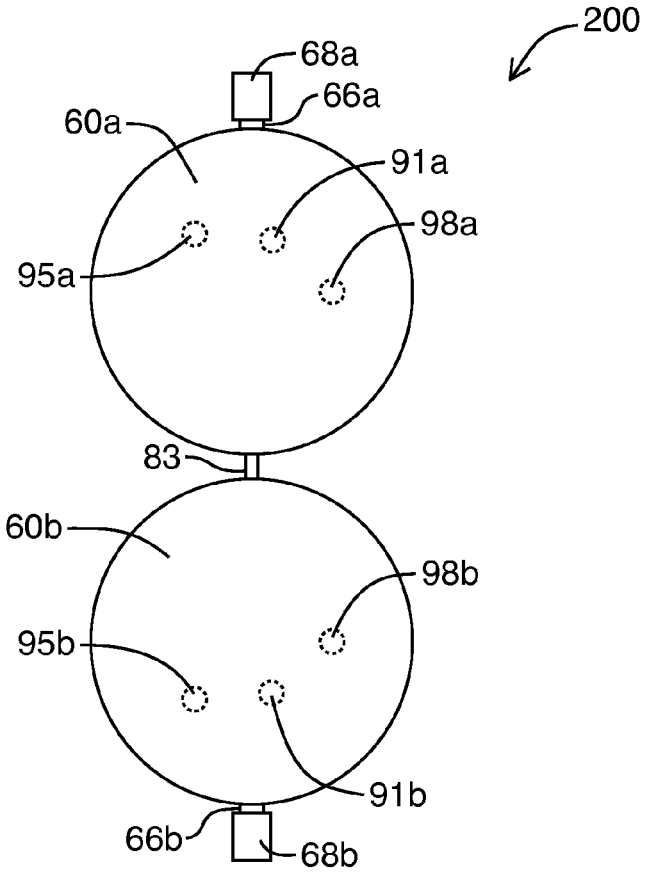
FIGS. 15A and 15B are top and perspective views of a 4-pole, planar-mounted microwave resonator filter constructed using an alternative configuration of the microwave resonator assembly of FIGS. 10A and 10B.
Figure 15B:
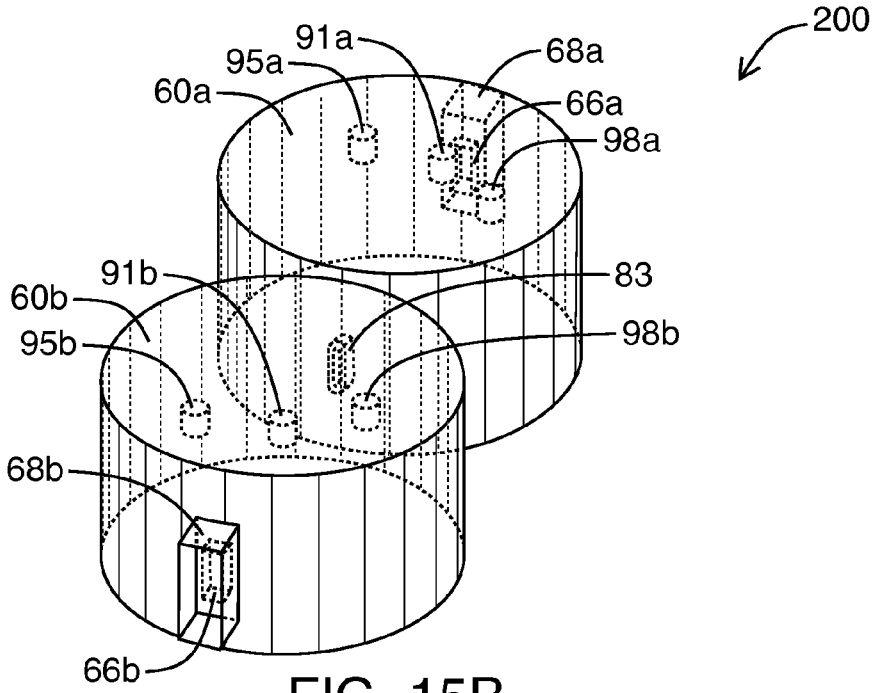

Referring now to FIGS. 15A and 15B, in an alternative configuration of the microwave resonator filter 200, a single longitudinal iris 83 is used to provide resonant mode coupling between the first and second cavities 60*a* and 60*b*. Coupling screw 91*a* placed in cavity 60*a* provides coupling between the first $TE_{22N}$ mode 70 and second $TE_{22N}$ mode 72 resonating therewithin. Similarly coupling screw 91*b* placed in cavity 60*b* provides coupling between the third $TE_{22N}$ mode 72 and fourth $TE_{22N}$ mode 70. The coupling screws 91*a* and 91*b* project through cavity end walls (as opposed to a side wall) at angular positions located substantially intermediate the characterizing vectors 74 and 76, where the $TE_{22N}$ modes 70 and 72 have non-zero field components. Tuning screw 95*a* is optionally included to adjust the resonant frequency the first $TE_{22N}$ mode 70 to a selected center frequency of the microwave resonator filter 200. Likewise, tuning screw 98*a* is optionally included to adjust the resonant frequency of the second $TE_{22N}$ mode to the selected centre frequency. Tuning screw 98*b* is optionally included to adjust the resonant frequency of the third $TE_{22N}$ mode 72 to the selected centre frequency of the microwave resonator filter 200, and tuning screw 95*b* is optionally included for the same purpose in relation to the fourth $TE_{22N}$ mode 70.

As discussed above, the single longitudinal iris 83 may provide coupling of the first and fourth $TE_{22N}$ modes 70 simultaneously with coupling of the second and third $TE_{22N}$ modes 72. However, the relative amounts of each type of mode coupling may generally depend on the angular position of the longitudinal iris 83 in relation to the characterizing vectors 74 and 76. At the angular position shown explicitly in FIGS. 15A and 15B, the longitudinal iris 83 (being offset an integer number of 90 degrees from the second characterizing vector 76) may predominantly couple the first and fourth $TE_{22N}$ modes 70. However, some amount of coupling of the second and third $TE_{22N}$ modes 72 excited in the cavities 60*a* and 60*b* will occur as well.

The sizing and axial positioning of the longitudinal iris 83 are again two of the free variables through which to control the amount of coupling provided to suit the particular application. However, as there is only the one longitudinal iris 83 used to couple each pair of mutually aligned $TE_{22N}$ modes, the realizable couplings may be somewhat constrained as compared to a filter configuration that utilizes two or more coupling elements. As will be appreciated, the inclusion of additional coupling elements increases the number of free variables, such as relative angular spacing and sizing, which can be optimized in the design process. As a third possible design variable, the angular position of the longitudinal iris 83 in relation to the characterizing vectors 74 and 76 can also be optimized. Thus, although not explicitly shown, the longitudinal iris 83 can also be translated 45-degrees to be offset an integer number of 90 degrees from the first characterizing vector 76. At this alternative angular position, the longitudinal iris 83 then predominantly couples the second and third $TE_{22N}$ modes 72. For intermediate couplings, some angular offset between this and the position shown in FIGS. 15A and 15B can be selected.

Figure 16A:
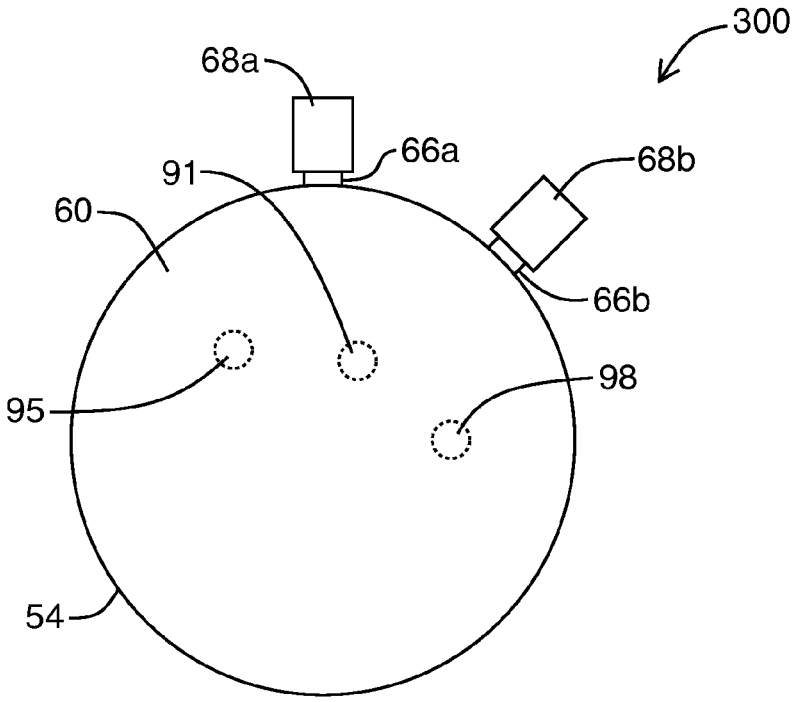
FIGS. 16A and 16B are top and perspective views of a 2-pole, single-cavity microwave resonator filter.
Figure 16B:
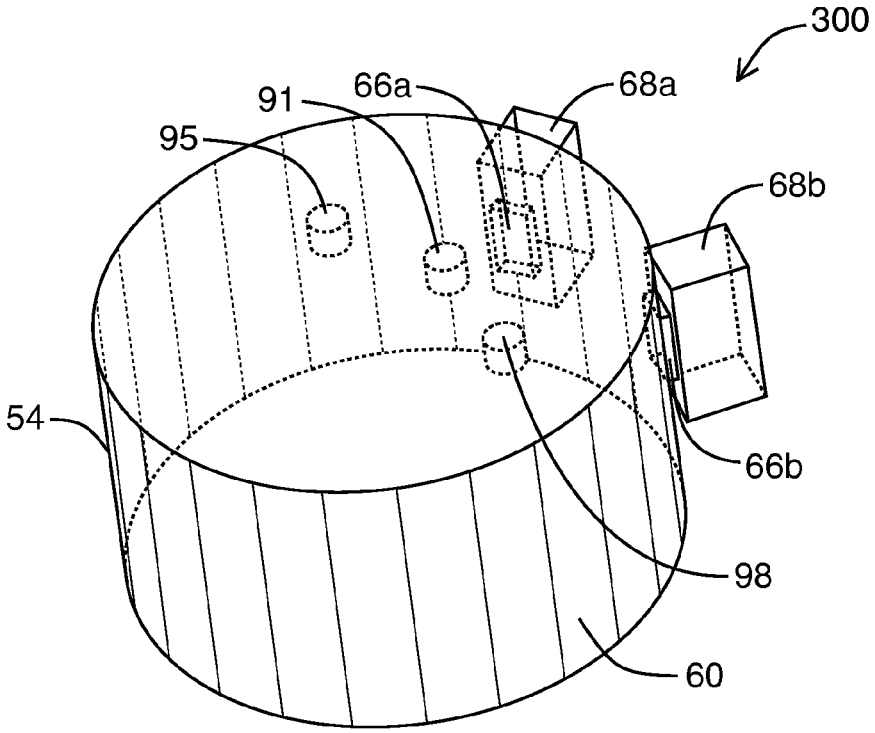

Referring now to FIGS. 16A and 16B, there is illustrated a microwave resonator filter 300 in perspective and top views. The microwave resonator filter 300 is formed using a single microwave resonator assembly 50 and, by operating in the dual $TE_{22N}$ mode, realizes a 2-pole bandpass characteristic. In the configuration shown, input port 66*a* and output port 66*b* are provided in a single cavity 60 and lead to external waveguide sections 68*a* and 68*b*, respective. The input port 66*a* excites the first $TE_{22N}$ mode 70 within cavity 60 and the output port 66*b*, being located 45-degrees offset from the input port 66*a*, is suitable for coupling the second $TE_{22N}$ mode 72. Coupling between the orthogonal $TE_{22N}$ modes 70 and 72 is provided, for example, using coupling screw 91. It should be appreciated however that one or more coupling screws 78 or 79 (not shown in FIG. 16A or 16B) could be used alternatively or additionally. Tuning screws 95 and 98 are included and used to make small adjustments to the resonant frequencies of the first and second $TE_{22N}$ modes 70 and 72, respectively.

Figure 17B:
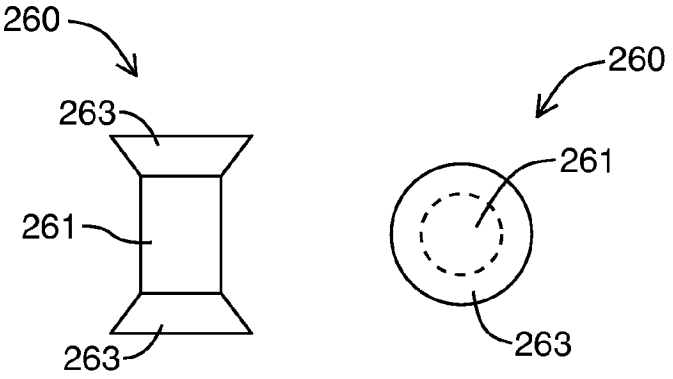
FIGS. 17A-17D are top and side views of alternative cavity geometries for a microwave resonator assembly.
Figure 17D:
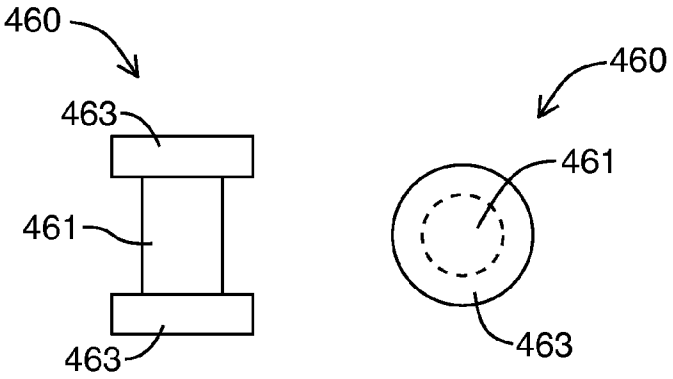
Figure 17A:
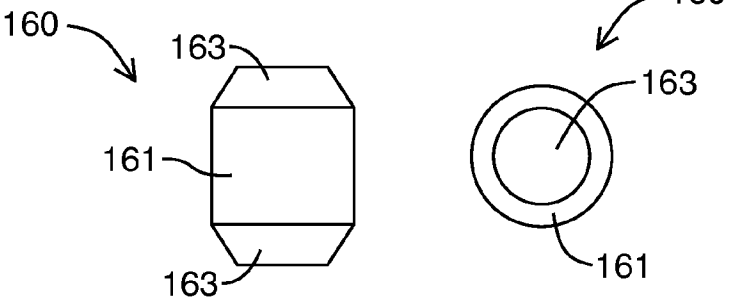
Figure 17C:
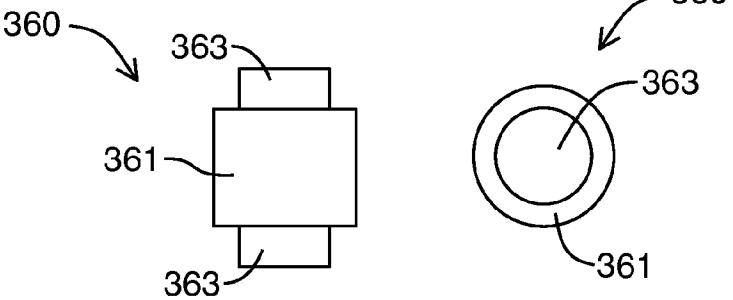

Referring now to FIGS. 17A-17D, alternative cavity geometries can be utilized in the resonator assembly 50 to adjust one or more performance characteristics. Each of the alternative geometries illustrated presents different boundary fields for the $TE_{22N}$ mode, relative to the cylindrical shape of the cavity 60. For example, in FIG. 17A, the cavity 160 comprises a central cylindrical section 161 between two inwardly tapered end sections 163. The cavity 260 shown in FIG. 17B similarly comprises a central cylindrical section 261, but now includes two outwardly tapered end sections 263. Alternatively, as seen in FIG. 17C, the cavity 360 can comprise central cylindrical 361 between two puck sections 363. Finally, the cavity 460 shown in FIG. 17D includes central cylindrical section 461 between two end flange sections 463.

Two of the performance characteristics that can be varied in the alternative cavity geometries are spurious performance and Q factor. For example, the outwardly tapering end sections 263 in FIG. 17B and the end flange sections 463 in FIG. 17D, which each represent an expansion of the corresponding cavity relative to its axial midsection, can offer better spurious performance on the low-frequency side of the passband. On the other hand, the inwardly tapering end sections 163 in FIG. 17A and the puck sections 363 in FIG. 17C, which each represent a narrowing of the corresponding cavity relative to its axial midsection, can offer better spurious performance on the high-frequency side of the passband. The inwardly tapering end sections 163 and the puck sections 363 also provide a larger Q factor relative to the cylindrical cavity 60.

While the above description provides examples and specific details of various embodiments, it will be appreciated that some of the described features and/or functions admit to modification without departing from the scope of the described embodiments. The detailed description of embodiments presented herein is intended to be illustrative of the invention, the scope of which is limited only by the language of the claims appended hereto.

The invention claimed is:

1. A microwave resonator assembly comprising:

a first cavity defined by an electrically conductive cylindrical enclosure in which electromagnetic energy radiated into the first cavity resonates in at least a dual $TE_{22N}$ mode having a first $TE_{22N}$ mode and a second $TE_{22N}$ mode, N greater than or equal to one;

an input port provided in the cylindrical enclosure for radiating the first $TE_{22N}$ mode having a first polarization into the first cavity; and a first discontinuity formed within the first cavity for electromagnetically coupling the first $TE_{22N}$ mode with the second $TE_{22N}$ mode having a second polarization orthogonal to the first polarization.

2. The microwave resonator assembly of claim 1, wherein the first $TE_{22N}$ mode defines a first characterizing vector projecting radially in relation to a longitudinal axis of the first cavity;

the second $TE_{22N}$ mode defines a second characterizing vector projecting radially in relation to the longitudinal axis and forming a 45 degree angle with the first characterizing vector; and the first discontinuity is formed at a location within the first cavity having an angular position intermediate the first and second characterizing vectors, where the first and second $TE_{22N}$ modes each have non-zero field components.

3. The microwave resonator assembly of claim 2, wherein the angular position of the first discontinuity is an angular midpoint between the first and second characterizing vectors.

4. The microwave resonator assembly of claim 3, wherein the input port has an angular position in relation to the second characterizing vector equal to an integer multiple of 90 degrees.

5. The microwave resonator assembly of claim 2, further comprising a plurality of discontinuities formed within the first cavity for electromagnetically coupling the first $TE_{22N}$ mode with the second $TE_{22N}$ mode, each discontinuity formed at a corresponding location within the first cavity having an angular position in relation to the first or second characterizing vector equal to 22.5 degrees plus an integer multiple of 90 degrees, where the first and second $TE_{22N}$ modes each have non-zero field components.

6. The microwave resonator assembly of claim 2, further comprising a plurality of discontinuities formed within the first cavity for adjusting a resonant frequency of the first $TE_{22N}$ mode or the second $TE_{22N}$ mode, each discontinuity formed at a corresponding location within the first cavity having an angular position in relation to either the first or second characterizing vector equal to an integer multiple of 90 degrees, where one of the first and second $TE_{22N}$ modes has field components substantially larger than the other of the first and second $TE_{22N}$ modes.

7. The microwave resonator assembly of claim 2, further comprising at least one direct coupling element provided in the cylindrical enclosure for radiating the second $TE_{22N}$ mode out of the first cavity; and at least one cross coupling element provided in the cylindrical enclosure for radiating the first $TE_{22N}$ mode out of the first cavity.

8. The microwave resonator filter of claim 1 further comprising:

a second cavity located adjacent to the first cavity, the second cavity defined by second electrically conductive cylindrical enclosure in which electromagnetic energy radiated into the second cavity resonates in at least a second dual $TE_{22N}$ mode having a third $TE_{22N}$ mode and a fourth $TE_{22N}$ mode, N greater than or equal to one;

at least one coupling element for radiating electromagnetic energy between the first cavity and the second cavity, the at least one coupling element configured to electromagnetically couple the first $TE_{22N}$ mode resonating in the first cavity with the fourth $TE_{22N}$ mode resonating in the second cavity, and the second $TE_{22N}$ mode resonating in the first cavity with the third $TE_{22N}$ mode resonating in the second cavity, the first and fourth $TE_{22N}$ modes having a first polarization and the second and third $TE_{22N}$ modes having a second polarization orthogonal to the first polarization; and a second discontinuity formed within the second cavity for electromagnetically coupling the third $TE_{22N}$ with the fourth $TE_{22N}$ mode.

9. The microwave resonator filter of claim 8, wherein the first $TE_{22N}$ mode defines a first characterizing vector projecting radially in relation to a longitudinal axis of the first cavity;

the second $TE_{22N}$ mode defines a second characterizing vector projecting radially in relation to the longitudinal axis and forming a 45 degree angle with the first characterizing vector; and the at least one coupling element comprises at least one direct coupling element for electromagnetically coupling the second $TE_{22N}$ mode with the third $TE_{22N}$ mode, the at least one direct coupling element having an angular position in relation to either the first or second characterizing vector equal to an integer multiple of 90 degrees.

10. The microwave resonator filter of claim 9, wherein the first and second cavities are collinear;

the at least one coupling element is formed in a common end wall separating the first and second cavities; and the at least one direct coupling element comprises a transverse angular iris having an angular position in relation to the second characterizing vector equal to an integer multiple of 90 degrees.

11. The microwave resonator filter of claim 9, wherein the first and second cavities are collinear;

the at least one coupling element is formed in a common end wall separating the first and second cavities; and the at least one direct coupling element comprises a radial iris having an angular position in relation to the first characterizing vector equal to an integer multiple of 90 degrees.

12. The microwave resonator filter of claim 9, wherein the first and second cavities are non-collinear;

the at least one coupling element is formed between adjacent sidewall portions of the first and second cavities; and the at least one direct coupling element comprises a transverse angular iris having an angular position in relation to the second characterizing vector equal to an integer multiple of 90 degrees.

13. The microwave resonator filter of claim 9, wherein the first and second cavities are non-collinear;

the at least one coupling element is formed between adjacent sidewall portions of the first and second cavities; and the at least one direct coupling element comprises a longitudinal iris having an angular position in relation to the first characterizing vector equal to an integer multiple of 90 degrees.

14. The microwave resonator filter of claim 9, wherein the at least one coupling element further comprises at least one cross coupling element for electromagnetically coupling the first $TE_{22N}$ mode with the fourth $TE_{22N}$ mode, the at least one cross coupling element having an angular position in relation to either the first or second characterizing vector equal to an integer multiple of 90 degrees.

15. The microwave resonator filter of claim 14, wherein the first and second cavities are collinear;

the at least one coupling element is formed in a common end wall separating the first and second cavities; and the at least one cross coupling element comprises a transverse angular iris having an angular position in relation to the first characterizing vector equal to an integer multiple of 90 degrees.

16. The microwave resonator filter of claim 14, wherein the first and second cavities are collinear;

the at least one coupling element is formed in a common end wall separating the first and second cavities; and the at least one cross coupling element comprises a radial iris having an angular position in relation to the second characterizing vector equal to an integer multiple of 90 degrees.

17. The microwave resonator filter of claim 14, wherein the first and second cavities are non-collinear;

the at least one coupling element is formed between adjacent sidewall portions of the first and second cavities; and the at least one cross coupling element comprises a longitudinal iris having an angular position in relation to the second characterizing vector equal to an integer multiple of 90 degrees.

18. The microwave resonator filter of claim 14, wherein the first and second cavities are non-collinear;

the at least one coupling element is formed between adjacent sidewall portions of the first and second cavities; and the at least one cross coupling element comprises a transverse angular iris having an angular position in relation to the first characterizing vector equal to an integer multiple of 90 degrees.

19. The microwave resonator filter of claim 8, wherein the first discontinuity is formed within the first cavity at a first location, and the second discontinuity is formed within the second cavity at a second location in relation to the first location to generate a transmission zero in the microwave resonator filter by coupling the first and second $TE_{22N}$ modes with a polarity opposite to the third and fourth $TE_{22N}$ modes.

* * * * *